US009355628B2

(12) United States Patent
Tachibana

(10) Patent No.: US 9,355,628 B2
(45) Date of Patent: May 31, 2016

(54) VOICE ANALYSIS METHOD AND DEVICE, VOICE SYNTHESIS METHOD AND DEVICE, AND MEDIUM STORING VOICE ANALYSIS PROGRAM

(71) Applicant: Yamaha Corporation, Hamamatsu-shi, Shizuoka-ken (JP)

(72) Inventor: Makoto Tachibana, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 14/455,652

(22) Filed: Aug. 8, 2014

(65) Prior Publication Data

US 2015/0040743 A1 Feb. 12, 2015

(30) Foreign Application Priority Data

Aug. 9, 2013 (JP) ..... 2013-166311

(51) Int. Cl.
*G10H 1/06* (2006.01)
*G10H 7/00* (2006.01)
(Continued)

(52) U.S. Cl.
CPC ..... *G10H 1/361* (2013.01); *G10H 7/00* (2013.01); *G10H 7/008* (2013.01); *G10H 7/02* (2013.01);
(Continued)

(58) Field of Classification Search
CPC . G10H 2210/091; G10H 1/361; G10H 1/366; G10H 2210/066; G10H 7/00; G10H 7/008; G10H 7/02; G10H 2210/051; G10H 2210/155; G10H 2210/00; G10L 13/0335; G10L 13/00; G10L 13/06; G10L 13/10
USPC ..... 84/622; 434/307 A
See application file for complete search history.

(56) References Cited

U.S. PATENT DOCUMENTS 5,621,182 A * 4/1997 Matsumoto ..... 84/610
5,641,927 A * 6/1997 Pawate et al. ..... 84/609
(Continued)

FOREIGN PATENT DOCUMENTS

EP 1 239 457 A2 9/2002
EP 1 455 340 A1 9/2004
(Continued)

OTHER PUBLICATIONS

Nakano, T. et al. (2011). "Vocalistener 2: A singing synthesis system able to mimic a user's singing in terms of voice timbre changes as well as pitch and dynamics," In Proceedings of the 36th International Conference on Acoustics, Speech and Signal Processing (ICASSP2011), p. 453-456.
(Continued)

*Primary Examiner* — Jeffrey Donels
(74) *Attorney, Agent, or Firm* — Morrison & Foerster LLP

(57) ABSTRACT

A voice analysis method includes a variable extraction step of generating a time series of a relative pitch. The relative pitch is a difference between a pitch generated from music track data, which continuously fluctuates on a time axis, and a pitch of a reference voice. The music track data designate respective notes of a music track in time series. The reference voice is a voice obtained by singing the music track. The pitch of the reference voice is processed by an interpolation processing for a voiceless section from which no pitch is detected. The voice analysis method also includes a characteristics analysis step of generating singing characteristics data that define a model for expressing the time series of the relative pitch generated in the variable extraction step.

23 Claims, 11 Drawing Sheets

(51) Int. Cl.

| | |
|---|---|
| ***G10H 1/36*** | (2006.01) |
| ***G10H 7/02*** | (2006.01) |
| ***G10L 13/033*** | (2013.01) |
| ***G10L 13/00*** | (2006.01) |
| ***G10L 13/06*** | (2013.01) |
| ***G10L 13/10*** | (2013.01) |

(52) U.S. Cl.

CPC ..... *G10L 13/00* (2013.01); *G10L 13/0335* (2013.01); *G10L 13/06* (2013.01); *G10L 13/10* (2013.01); *G10H 2210/00* (2013.01); *G10H 2210/051* (2013.01); *G10H 2210/066* (2013.01); *G10H 2210/091* (2013.01); *G10H 2210/095* (2013.01); *G10H 2210/325* (2013.01); *G10H 2210/331* (2013.01); *G10H 2220/155* (2013.01); *G10H 2240/121* (2013.01); *G10H 2250/455* (2013.01)

(56) References Cited

U.S. PATENT DOCUMENTS

| | | | | |
|---|---|---|---|---|
| 5,804,752 | A * | 9/1998 | Sone et al. | 84/610 |
| 5,889,224 | A * | 3/1999 | Tanaka | 84/645 |
| 5,955,693 | A * | 9/1999 | Kageyama | 84/610 |
| 6,307,140 | B1 * | 10/2001 | Iwamoto | 84/622 |
| 2001/0044721 | A1 * | 11/2001 | Yoshioka et al. | 704/258 |
| 2003/0055646 | A1 * | 3/2003 | Yoshioka et al. | 704/258 |
| 2009/0306987 | A1 | 12/2009 | Nakano et al. | |
| 2009/0326950 | A1 | 12/2009 | Matsumoto | |
| 2010/0126331 | A1 * | 5/2010 | Golovkin et al. | 84/610 |
| 2011/0000360 | A1 | 1/2011 | Saino et al. | |
| 2012/0031257 | A1 | 2/2012 | Saino | |
| 2012/0103167 | A1 | 5/2012 | Saino et al. | |
| 2015/0255088 | A1 * | 9/2015 | Roberge et al. | 704/239 |

FOREIGN PATENT DOCUMENTS

| | | | |
|---|---|---|---|
| EP | 2 270 773 | A1 | 1/2011 |
| EP | 2 276 019 | A1 | 1/2011 |
| EP | 2 416 310 | A2 | 2/2012 |
| JP | 2003-323188 | A | 11/2003 |
| JP | 2011-013454 | A | 1/2011 |
| JP | 2012-037722 | A | 2/2012 |

OTHER PUBLICATIONS

Tachibana, M. et al. (2005). "Speech synthesis with various emotional expressions and speaking styles by style interpolation and morphing," IEICE Trans, Information and systems, E88-D, No. 11, pp. 2484-2491.

European Search Report dated Nov. 11, 2015, for EP Application No. 15185625.9, four pages.

European Search Report dated Dec. 1, 2015, for EP Application No. 15185624.2, six pages.

Stables, R. et al. (Mar. 9, 2011). "Fundamental Frequency Modulation in Singing Voice Synthesis,", Speech, Sound and Music Processing, Embracing Research in India, Springer Berlin Heidelberg, Berlin, Heidelberg, pp. 104-119.

* cited by examiner

VOICE ANALYSIS METHOD AND DEVICE, VOICE SYNTHESIS METHOD AND DEVICE, AND MEDIUM STORING VOICE ANALYSIS PROGRAM

CROSS-REFERENCE TO RELATED APPLICATION

The present application claims priority from Japanese application JP 2013-166311 filed on Aug. 9, 2013, the content of which is hereby incorporated by reference into this application.

BACKGROUND OF THE INVENTION

1. Field of the Invention

The present invention relates to a voice analysis method, a voice analysis device, a voice synthesis method, a voice synthesis device, and a computer readable medium storing a voice analysis program.

2. Description of the Related Art

There is proposed a technology for generating a time series of a feature amount of a sound by using a probabilistic model for expressing a probabilistic transition between a plurality of statuses. For example, in a technology disclosed in Japanese Patent Application Laid-open No. 2011-13454, a probabilistic model using a hidden Markov model (HMM) is used to generate a time series (pitch curve) of a pitch. A singing voice for a desired music track is synthesized by driving a sound generator (for example, sine-wave generator) in accordance with the time series of the pitch generated from the probabilistic model and executing filter processing corresponding to phonemes of lyrics. However, in the technology disclosed in Japanese Patent Application Laid-open No. 2011-13454, a probabilistic model is generated for each combination of adjacent notes, and hence probabilistic models need to be generated for a large number of combinations of notes in order to generate singing voices for a variety of music tracks.

Japanese Patent Application Laid-open No. 2012-37722 discloses a configuration for generating a probabilistic model of a relative value (relative pitch) between the pitch of each of notes forming a music track and the pitch of the singing voice for the music track. In the technology disclosed in Japanese Patent Application Laid-open No. 2012-37722, the probabilistic model is generated by using the relative pitch, which is advantageous in that there is no need to provide a probabilistic model for each of the large number of combinations of notes.

SUMMARY OF THE INVENTION

However, in the technology disclosed in Japanese Patent Application Laid-open No. 2012-37722, a pitch of each of notes of a music track fluctuates discretely (discontinuously), and hence a relative pitch fluctuates discontinuously at a time point of a boundary between the respective notes different in pitch. Therefore, a synthesized voice generated by applying the relative pitch may sound an auditorily unnatural voice. In view of the above-mentioned circumstances, an object of one or more embodiments of the present invention is to generate a time series of a relative pitch capable of generating a synthesized voice that sounds auditorily natural.

In one or more embodiments of the present invention, a voice analysis method includes a variable extraction step of generating a time series of a relative pitch. The relative pitch is a difference between a pitch generated from music track data, which continuously fluctuates on a time axis, and a pitch of a reference voice. The music track data designate respective notes of a music track in time series. The reference voice is a voice obtained by singing the music track. The pitch of the reference voice is processed by an interpolation processing for a voiceless section from which no pitch is detected. The voice analysis method also includes a characteristics analysis step of generating singing characteristics data that define a model for expressing the time series of the relative pitch generated in the variable extraction step.

In one or more embodiments of the present invention, a voice analysis device includes a variable extraction unit configured to generate a time series of a relative pitch. The relative pitch is a difference between a pitch generated from music track data, which continuously fluctuates on a time axis, and a pitch of a reference voice. The music track data designate respective notes of a music track in time series. The reference voice is a voice obtained by singing the music track. The pitch of the reference voice is processed by an interpolation processing for a voiceless section from which no pitch is detected. The voice analysis device also includes a characteristics analysis unit configured to generate a singing characteristics data that defines a model for expressing the time series of the relative pitch generated by the variable extraction unit.

In one or more embodiments of the present invention, a non-transitory computer-readable recording medium having stored thereon a voice analysis program, the voice analysis program includes a variable extraction instruction for generating a time series of a relative pitch. The relative pitch is a difference between a pitch generated from music track data, which continuously fluctuates on a time axis, and a pitch of a reference voice. The music track data designate respective notes of a music track in time series. The reference voice is a voice obtained by singing the music track. The pitch of the reference voice is processed by an interpolation processing for a voiceless section from which no pitch is detected. The voice analysis program also includes a characteristics analysis instruction for generating singing characteristics data that define a model for expressing the time series of the relative pitch generated by the variable extraction instruction.

In one or more embodiments of the present invention, a voice synthesis method includes a variable setting step of generating a relative pitch transition based on synthesis-purpose music track data and at least one singing characteristic data. The synthesis-purpose music track data designate respective notes of a first music track to be subjected to voice synthesis in time series. The at least one singing characteristic data define a model expressing a time series of a relative pitch. The relative pitch is a difference between a first pitch and a second pitch. The first pitch is generated from music track data for designating respective notes of a second music track in time series and continuously fluctuates on a time axis. The second pitch is a pitch of a reference voice that is obtained by singing the second music track. The second pitch is processed by interpolation processing for a voiceless section from which no pitch is detected. The voice synthesis method also includes a voice synthesis step of generating a voice signal based on the synthesis-purpose music track data, phonetic piece group indicating respective phonemes, and the relative pitch transition.

In one or more embodiments of the present invention, a voice synthesis device includes a variable setting unit configured to generate a relative pitch transition based on synthesis-purpose music track data and at least one singing characteristic data. The synthesis-purpose music track data designate respective notes of a first music track to be subjected to voice synthesis in time series. The at least one singing characteristic data define a model expressing a time series of a relative pitch. The relative pitch is a difference between a first pitch and a second pitch. The first pitch is generated from music track data for designating respective notes of a second music track in time series and continuously fluctuates on a time axis. The second pitch is a pitch of a reference voice that is obtained by singing the second music track. The second pitch is processed by interpolation processing for a voiceless section from which no pitch is detected. The voice synthesis device also includes a voice synthesis unit configured to generate a voice signal based on the synthesis-purpose music track data, phonetic piece group indicating respective phonemes, and the relative pitch transition.

In order to solve the above-mentioned problems, a voice analysis device according to one embodiment of the present invention includes a variable extraction unit configured to generate a time series of a relative pitch serving as a difference between a pitch which is generated from music track data for designating each of notes of a music track in time series and which continuously fluctuates on a time axis and a pitch of a reference voice obtained by singing the music track; and a characteristics analysis unit configured to generate singing characteristics data that defines a probabilistic model for expressing the time series of the relative pitch generated by the variable extraction unit. In the above-mentioned configuration, the time series of the relative pitch serving as the difference between the pitch which is generated from the music track data and which continuously fluctuates on the time axis and the pitch of the reference voice is expressed as a probabilistic model, and hence a discontinuous fluctuation of the relative pitch is suppressed compared to a configuration in which a difference between the pitch of each of the notes of the music track and the pitch of the reference voice is calculated as the relative pitch. Therefore, it is possible to generate the synthesized voice that sounds auditorily natural.

According to a preferred embodiment of the present invention, the variable extraction unit includes: a transition generation unit configured to generate the pitch that continuously fluctuates on the time axis from the music track data; a pitch detection unit configured to detect the pitch of the reference voice obtained by singing the music track; an interpolation processing unit configured to set a pitch for a voiceless section of the reference voice from which no pitch is detected; and a difference calculation unit configured to calculate a difference between the pitch generated by the transition generation unit and the pitch that has been processed by the interpolation processing unit as the relative pitch. In the above-mentioned configuration, the pitch is set for the voiceless section from which no pitch of the reference voice is detected, to thereby shorten a silent section. Therefore, there is an advantage in that the discontinuous fluctuation of the relative pitch can be effectively suppressed. According to a further preferred embodiment of the present invention, the interpolation processing unit is further configured to: set, in accordance with the time series of the pitch within a first section immediately before the voiceless section, a pitch within a first interpolation section of the voiceless section immediately after the first section; and set, in accordance with the time series of the pitch within a second section immediately after the voiceless section, a pitch within a second interpolation section of the voiceless section immediately before the second section. In the above-mentioned embodiment, the pitch within the voiceless section is approximately set in accordance with the pitches within a voiced section before and after the voiceless section, and hence the above-mentioned effect of suppressing the discontinuous fluctuation of the relative pitch within the voiced section of the music track designated by the music track data is remarkable.

According to a preferred embodiment of the present invention, the characteristics analysis unit includes: a section setting unit configured to divide the music track into a plurality of unit sections by using a predetermined duration as a unit; and an analysis processing unit configured to generate the singing characteristics data including, for each of a plurality of statuses of the probabilistic model: a decision tree for classifying the plurality of unit sections obtained by the dividing by the section setting unit into a plurality of sets; and variable information for defining a probability distribution of the time series of the relative pitch within each of the unit sections classified into the respective sets. In the above-mentioned embodiment, the probabilistic model is defined by using a predetermined duration as a unit, which is advantageous in that, for example, singing characteristics (relative pitch) can be controlled with precision irrespective of a length of a duration compared to a configuration in which the probabilistic model is assigned by using the note as a unit.

When a completely independent decision tree is generated for each of a plurality of statuses of the probabilistic model, characteristics of the time series of the relative pitch within the unit section may differ between the statuses, with the result that the synthesized voice may become a voice that gives an impression of sounding unnatural (for example, voice that cannot be pronounced in actuality or voice different from an actual pronunciation). In view of the above-mentioned circumstances, the analysis processing unit according to the preferred embodiment of the present invention generates a decision tree for each status from a basic decision tree common across the plurality of statuses of the probabilistic model. In the above-mentioned embodiment, the decision tree for each status is generated from the basic decision tree common across the plurality of statuses of the probabilistic model, which is advantageous in that, compared to a configuration in which a mutually independent decision tree is generated for each of the statuses of the probabilistic model, a possibility that the characteristics of the transition of the relative pitch excessively differs between adjacent statuses is reduced, and the synthesized voice that sounds auditorily natural (for example, voice that can be pronounced in actuality) can be generated. Note that, the decision trees for the respective statuses generated from the common basic decision tree are partially or entirely common to one another.

According to a preferred embodiment of the present invention, the decision tree for each status contains a condition corresponding to a relationship between each of phrases obtained by dividing the music track on the time axis and the unit section. In the above-mentioned embodiment, the condition relating to the relationship between the unit section and the phrase is set for each of nodes of the decision tree, and hence it is possible to generate the synthesized voice that sounds auditorily natural in which the relationship between the unit section and the phrase is taken into consideration.

DETAILED DESCRIPTION OF THE INVENTION

First Embodiment

Figure 1:
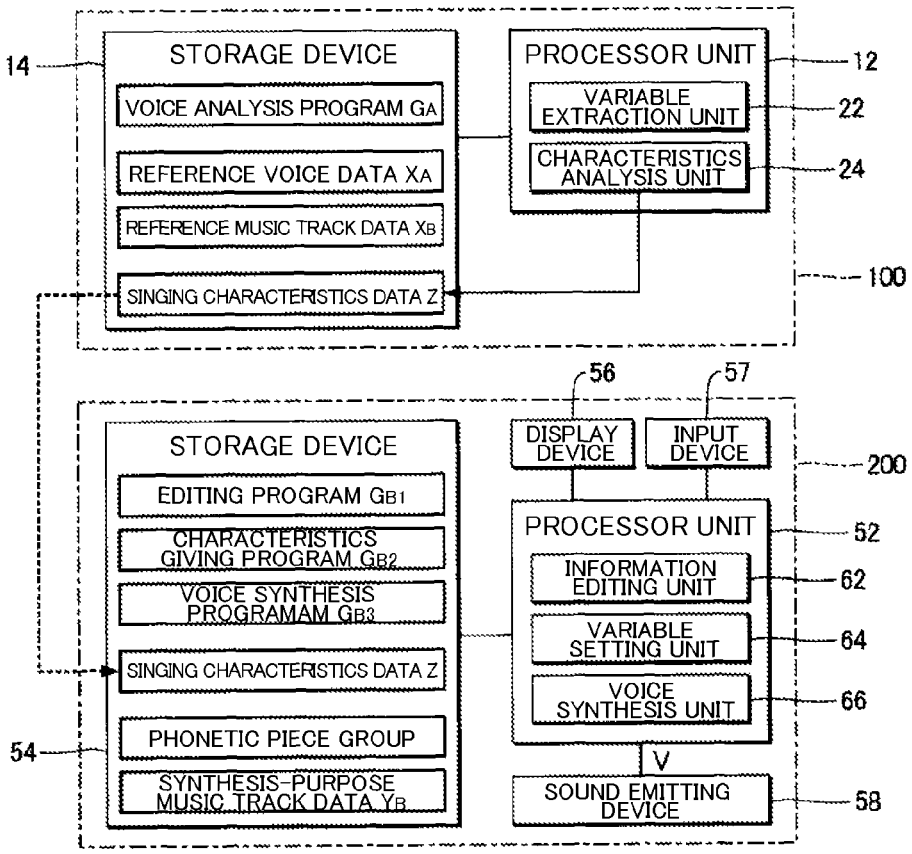
FIG. 1 is a block diagram of a voice processing system according to a first embodiment of the present invention.

FIG. 1 is a block diagram of a voice processing system according to a first embodiment of the present invention. The voice processing system is a system for generating and using data for voice synthesis, and includes a voice analysis device 100 and a voice synthesis device 200. The voice analysis device 100 generates a singing characteristics data Z indicating a singing style of a specific singer (hereinafter referred to as "reference singer"). The singing style means, for example, an expression method such as a way of singing unique to the reference singer (for example, expression contours) or a musical expression (for example, preparation, overshoot, and vibrato). The voice synthesis device 200 generates a voice signal V of a singing voice for an arbitrary music track, on which the singing style of the reference singer is reflected, by a voice synthesis that applies the singing characteristics data Z generated by the voice analysis device 100. That is, even when a singing voice of the reference singer does not exist for a desired music track, it is possible to generate the singing voice for the music track to which the singing style of the reference singer is added (that is, a voice of the reference singer singing the music track). Note that, in FIG. 1, the voice analysis device 100 and the voice synthesis device 200 are exemplified as separate devices, but the voice analysis device 100 and the voice synthesis device 200 may be realized as a single device.

(Voice Analysis Device 100)

As exemplified in FIG. 1, the voice analysis device 100 is realized by a computer system including a processor unit 12 and a storage device 14. The storage device 14 stores a voice analysis program GA executed by the processor unit 12 and various kinds of data used by the processor unit 12. A known recording medium such as a semiconductor recording medium or a magnetic recording medium or a combination of a plurality of kinds of recording medium may be arbitrarily employed as the storage device 14.

The storage device 14 according to the first embodiment stores reference music track data XB and reference voice data XA used to generate the singing characteristics data Z. As exemplified in FIG. 2, the reference voice data XA expresses a waveform of a voice (hereinafter referred to as "reference voice") of the reference singer singing a specific music track (hereinafter referred to as "reference music track"). On the other hand, the reference music track data XB expresses a musical notation (score) of the reference music track corresponding to the reference voice data XA. Specifically, as understood from FIG. 2, the reference music track data XB is time-series data (for example, VSQ-format file, MusicXML, SMF (Standard MIDI File)) for designating a pitch, a pronunciation period, and a lyric (character for vocalizing) for each of notes forming the reference music track in time series.

The processor unit 12 illustrated in FIG. 1 executes the voice analysis program GA stored in the storage device 14 and realizes a plurality of functions (a variable extraction unit 22 and a characteristics analysis unit 24) for generating the singing characteristics data Z on the reference singer. Note that, a configuration in which the respective functions of the processor unit 12 are distributed to a plurality of devices or a configuration in which a part of the functions of the processor unit 12 is realized by a dedicated electronic circuit (for example, DSP) may also be employed.

The variable extraction unit 22 acquires a time series of a feature amount of the reference voice expressed by the reference voice data XA. The variable extraction unit 22 according to the first embodiment successively calculates, as the feature amount, a difference (hereinafter referred to as "relative pitch") R between a pitch PB of a voice (hereinafter referred to as "synthesized voice") generated by the voice synthesis to which the reference music track data XB is applied and a pitch PA of the reference voice expressed by the reference voice data XA. That is, the relative pitch R may also be paraphrased as a numerical value of a pitch bend of the reference voice (fluctuation amount of the pitch PA of the reference voice with reference to the pitch PB of the synthesized voice). As exemplified in FIG. 3, the variable extraction unit 22 according to the first embodiment includes a transition generation unit 32, a pitch detection unit 34, an interpolation processing unit 36, and a difference calculation unit 38.

The transition generation unit 32 sets a transition (hereinafter referred to as "synthesized pitch transition") CP of the pitch PB of the synthesized voice generated by the voice synthesis to which the reference music track data XB is applied. In concatenative voice synthesis to which the reference music track data XB is applied, the synthesized pitch transition (pitch curve) CP is generated in accordance with the pitches and the pronunciation periods designated by the reference music track data XB for the respective notes, and phonetic pieces corresponding to the lyrics on the respective notes are adjusted to the pitches PB of the synthesized pitch transition CP to be concatenated with each other, thereby generating the synthesized voice. The transition generation unit 32 generates the synthesized pitch transition CP in accordance with the reference music track data XB on the reference music track. As understood from the above description, the synthesized pitch transition CP corresponds to a model (typical) trace of the pitch PB of the reference music track by the singing voice. Note that, the synthesized pitch transition CP may be used for the voice synthesis as described above, but on the voice analysis device 100 according to the first embodiment, it is not essential to actually generate the synthesized voice as long as the synthesized pitch transition CP corresponding to the reference music track data XB is generated.

Figure 2:
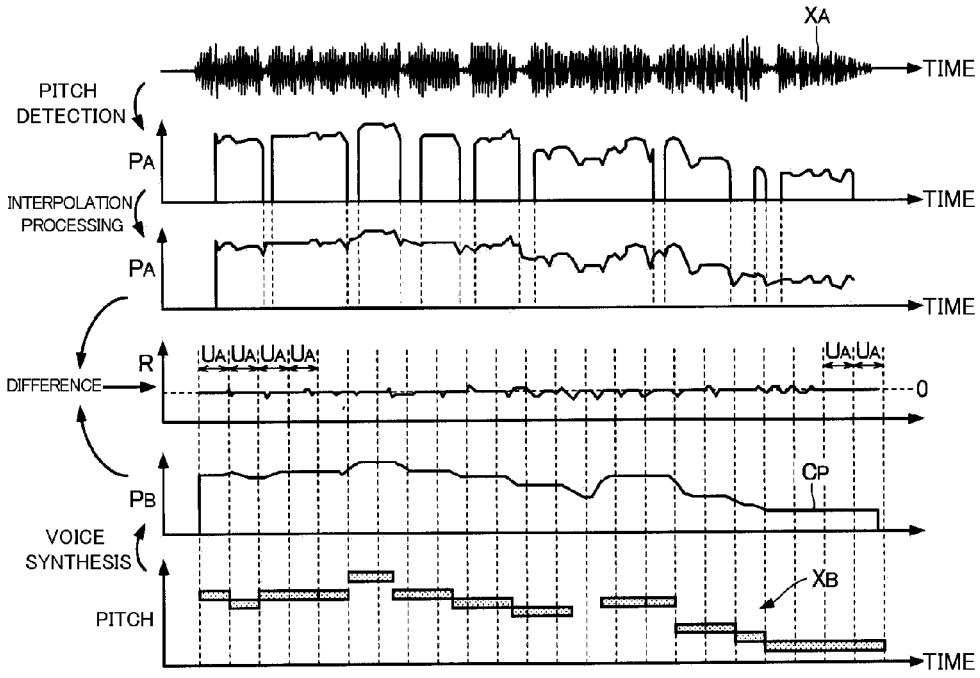
FIG. 2 is an explanatory diagram of an operation of a variable extraction unit.

FIG. 2 shows the synthesized pitch transition CP generated from the reference music track data XB. As exemplified in FIG. 2, the pitch designated by the reference music track data XB for each note fluctuates discretely (discontinuously), while the pitch PB continuously fluctuates in the synthesized pitch transition CP of the synthesized voice. That is, the pitch PB of the synthesized voice continuously fluctuates from the numerical value of the pitch corresponding to an arbitrary one note to the numerical value of the pitch corresponding to the subsequent note. As understood from the above description, the transition generation unit 32 according to the first embodiment generates the synthesized pitch transition CP so that the pitch PB of the synthesized voice continuously fluctuates on a time axis. Note that, the synthesized pitch transition CP may be generated by using a technology as disclosed in, for example, paragraphs 0074 to 0081 of Japanese Patent Application Laid-open No. 2003-323188. In the technology, the pitch changes naturally at a time point at which the phonetic unit changes by giving a pitch model to a discontinuous curve of a pitch change before and after the change of the phonetic unit in performing the vocal synthesis. In this case, the "curve of the pitch change to which the pitch model is given" disclosed in Japanese Patent Application Laid-open No. 2003-323188 corresponds to, for example, the "synthesized pitch transition" according to this embodiment.

Figure 3:
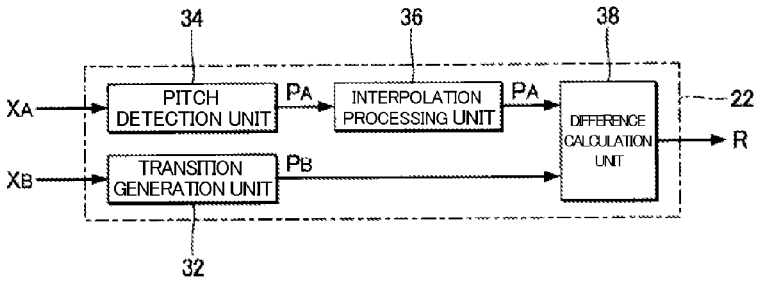
FIG. 3 is a block diagram of the variable extraction unit.

The pitch detection unit 34 illustrated in FIG. 3 successively detects the pitch PA of the reference voice expressed by the reference voice data XA. A known technology is arbitrarily employed for the detection of the pitch PA. As understood from FIG. 2, the pitch PA is not detected from a voiceless section (for example, a consonant section or a silent section) of the reference voice in which a harmonic wave structure does not exist. The interpolation processing unit 36 illustrated in FIG. 3 sets (interpolates) the pitch PA for the voiceless section of the reference voice.

Figure 4:
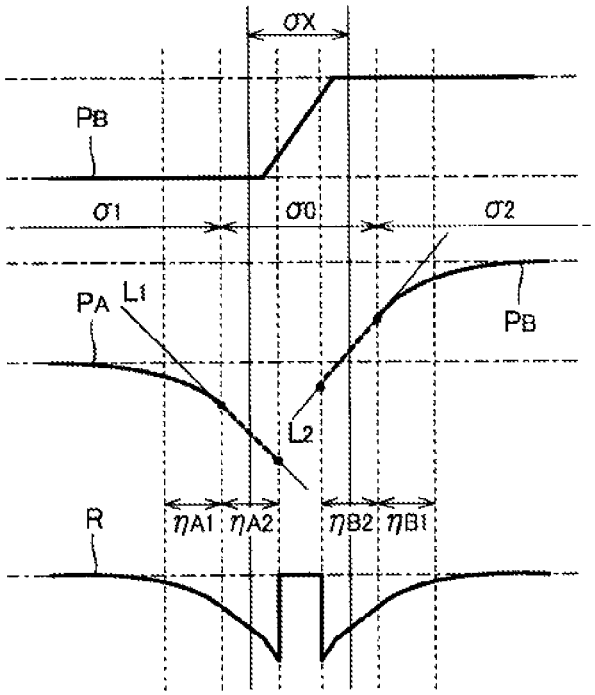
FIG. 4 is an explanatory diagram of an operation of an interpolation processing unit.

FIG. 4 is an explanatory diagram of an operation of the interpolation processing unit 36. A voiced section σ1 and a voiced section σ2, in which the pitch PA of the reference voice is detected, and a voiceless section (consonant section or silent section) σ0 therebetween are exemplified in FIG. 4. The interpolation processing unit 36 sets the pitch PA within the voiceless section σ0 in accordance with the time series of the pitch PA within the voiced section σ1 and the voiced section σ2.

Specifically, the interpolation processing unit 36 sets the time series of the pitch PA within an interpolation section (first interpolation section) ηA2, which has a predetermined length and is located on a start point side of the voiceless section σ0, in accordance with the time series of the pitch PA within a section (first section) ηA1, which has a predetermined length and is located on an end point side of the voiced section σ1. For example, each numerical value on an approximate line (for example, regression line) L1 of the time series of the pitch PA within the section ηA1 is set as the pitch PA within the interpolation section ηA2 immediately after the section ηA1. That is, the time series of the pitch PA within the voiced section σ1 is also extended to the voiceless section σ0 so that the transition of the pitch PA continues across from the voiced section σ1 (section ηA1) to the subsequent voiceless section σ0 (interpolation section ηA2).

Similarly, the interpolation processing unit 36 sets the time series of the pitch PA within an interpolation section (second interpolation section) ηB2, which has a predetermined length and is located at an end point side of the voiceless section σ0, in accordance with the time series of the pitch PA within a section (second section) ηB1, which has a predetermined length and is located on a start point side of the voiced section σ2. For example, each numerical value on an approximate line (for example, regression line) L2 of the time series of the pitch PA within the section ηB1 is set as the pitch PA within the interpolation section ηB2 immediately before the section ηB1. That is, the time series of the pitch PA within the voiced section σ2 is also extended to the voiceless section σ0 so that the transition of the pitch PA continues across from the voiced section σ2 (section ηB1) to the voiceless section σ0 (interpolation section ηB2) immediately before. Note that, the section ηA1 and the interpolation section ηA2 are set to a mutually equal time length, and the section ηB1 and the interpolation section ηB2 are set to a mutually equal time length. However, the time length may be different between the respective sections. Further, the time length may be either different or the same between the section ηA1 and the section ηB1, and the time length may be either different or the same between the interpolation section ηA2 and the interpolation section ηB2.

As exemplified in FIG. 2 and FIG. 4, the difference calculation unit 38 illustrated in FIG. 3 successively calculates a difference between the pitch PB (synthesized pitch transition CP) of the synthesized voice calculated by the transition generation unit 32 and the pitch PA of the reference voice that is processed by the interpolation processing unit 36 as the relative pitch R (R=PB-PA). As exemplified in FIG. 4, when the interpolation section ηA2 and the interpolation section ηB2 are spaced apart from each other within the voiceless section σ0, the difference calculation unit 38 sets the relative pitch R within an interval between the interpolation section ηA2 and the interpolation section ηB2 to a predetermined value (for example, zero). The variable extraction unit 22 according to the first embodiment generates the time series of the relative pitch R by the above-mentioned configuration and processing.

The characteristics analysis unit 24 illustrated in FIG. 1 analyzes the time series of the relative pitch R generated by the variable extraction unit 22 so as to generate the singing characteristics data Z. As exemplified in FIG. 5, the characteristics analysis unit 24 according to the first embodiment includes a section setting unit 42 and an analysis processing unit 44.

The section setting unit 42 divides the time series of the relative pitch R generated by the variable extraction unit 22 into a plurality of sections (hereinafter referred to as "unit section") UA on the time axis. Specifically, as understood from FIG. 2, the section setting unit 42 according to the first embodiment divides the time series of the relative pitch R into the plurality of unit sections UA on the time axis by using a predetermined duration (hereinafter referred to as "segment") as a unit. The segment has, for example, a time length corresponding to a sixteenth note. That is, one unit section UA includes the time series of the relative pitch R over the section corresponding to the segment within the reference music track. The section setting unit 42 sets the plurality of unit sections UA within the reference music track by referring to the reference music track data XB.

Figure 5:
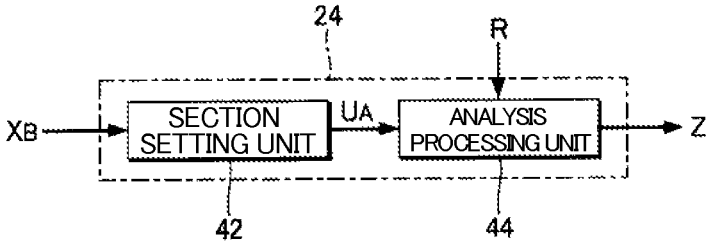
FIG. 5 is a block diagram of a characteristics analysis unit.
Figure 6:
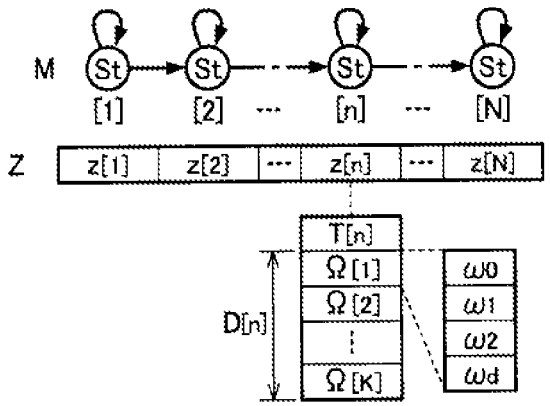
FIG. 6 is an explanatory diagram of a probabilistic model and a singing characteristics data.

The analysis processing unit 44 illustrated in FIG. 5 generates the singing characteristics data Z of the reference singer in accordance with the relative pitch R for each of the unit sections UA generated by the section setting unit 42. A probabilistic model M illustrated in FIG. 6 is used to generate the singing characteristics data Z. The probabilistic model M according to the first embodiment is a hidden semi Markov model (HSMM) defined by N statuses St (N is a natural number equal to or greater than two). As exemplified in FIG. 6, the singing characteristics data Z includes N pieces of unit data z[n] (z[1] to z[N]) corresponding to the mutually different statuses St of the probabilistic model M. One piece of unit data z[n] corresponding to an n-th (n=1 to N) status St of the probabilistic model M includes a decision tree T[n] and variable information D[n].

Figure 7:
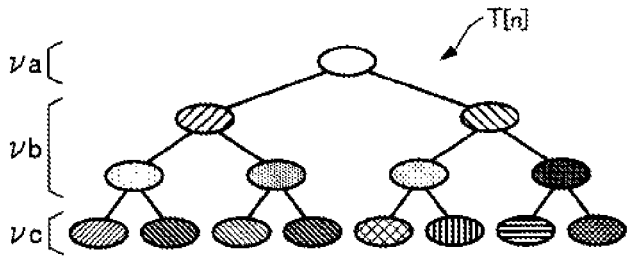
FIG. 7 is an explanatory diagram of a decision tree.

The analysis processing unit 44 generates the decision tree T[n] by machine learning (decision tree learning) for successively determining whether or not a predetermined condition (question) relating to the unit section UA is successful. The decision tree T[n] is a classification tree for classifying (clustering) the unit sections UA into a plurality of sets, and is expressed as a tree structure in which a plurality of nodes ν (νa, νb, and νc) are concatenated with one another over a plurality of tiers. As exemplified in FIG. 7, the decision tree T[n] includes a root node νa serving as a start position of classification, a plurality of (K) leaf nodes νc corresponding to the final-stage classification, and internal nodes (inner nodes) νb located at branch points on a path from the root node νa to each of the leaf nodes νc.

At the root node νa and the internal nodes νb, for example, it is determined whether conditions are met (context) such as whether the unit section UA is the silent section, whether the note within the unit section UA is shorter than the sixteenth note, whether the unit section UA is located at the start point side of the note, and whether the unit section UA is located at the end point side of the note. A time point to stop the classification of the respective unit sections UA (time point to determine the decision tree T[n]) is determined in accordance with, for example, a minimum description length (MDL) reference. A structure (for example, the number of internal nodes νb, and conditions thereof, and the number k of leaf nodes νc) of the decision tree T[ n] is different between the respective statuses St of the probabilistic model M.

The variable information D[ n] on the unit data z[n] illustrated in FIG. 6 is information that defines the variable (probability) relating to the n-th status St of the probabilistic model M, and as exemplified in FIG. 6, includes K variable groups Ω[k] Ω[1] to Ω[K]) corresponding to the mutually different leaf nodes νc of the decision tree T[n]. A k-th (k=1 to K) variable group Ω[k] of the variable information D[n] is a set of variables corresponding to the relative pitch R within each of the unit sections UA classified into the k-th one leaf node νc among the K leaf nodes νc of the decision tree T[n], and includes a variable ω0, a variable ω1, a variable ω2, and a variable cod. Each of the variable ω0, the variable ω1, and the variable ω2 is a variable (for example, average and distribution of the probability distribution) that defines a probability distribution of an occurrence probability relating to the relative pitch R. Specifically, the variable ω0 defines the probability distribution of the relative pitch R, the variable ω1 defines the probability distribution of a time variation (derivative value) ΔR of the relative pitch R, and the variable ω2 defines the probability distribution of a second derivative value $\Delta^2R$ of the relative pitch. Further, the variable cod is a variable (for example, average and distribution of the probability distribution) that defines the probability distribution of the duration of the status St. The analysis processing unit 44 sets the variable group Ω[k] (ω0 to ω2 and ωd) of the variable information D[n] of the unit data z[n] so that the occurrence probability of the relative pitch R of the plurality of unit sections UA classified into the k-th leaf node νc of the decision tree T[n] corresponding to the n-th status St of the probabilistic model M becomes maximum. The singing characteristics data Z including the decision tree T[n] and the variable information D[n] generated by the above-mentioned procedure for each of the statuses St of the probabilistic model M is stored on the storage device 14.

Figure 8:
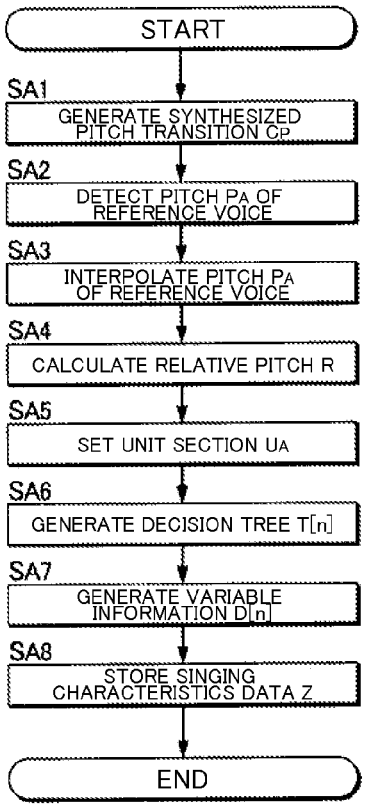
FIG. 8 is a flowchart of an operation of a voice analysis device.

FIG. 8 is a flowchart of processing executed by the voice analysis device 100 (processor unit 12) to generate the singing characteristics data Z. For example, when a startup of the voice analysis program GA is instructed, the processing of FIG. 8 is started. When the voice analysis program GA is started up, the transition generation unit 32 generates the synthesized pitch transition CP (pitch PB) from the reference music track data XB (SA1). Further, the pitch detection unit 34 detects the pitch PA of the reference voice expressed by the reference voice data XA (SA2), and the interpolation processing unit 36 sets the pitch PA within the voiceless section of the reference voice by interpolation using the pitch PA detected by the pitch detection unit 34 (SA3). The difference calculation unit 38 calculates a difference between each of the pitches PB generated in Step SA1 and each pitch PA that is subjected to the interpolation in Step SA3 as the relative pitch R (SA4).

On the other hand, the section setting unit 42 refers to the reference music track data XB, so as to divide the reference music track into the plurality of unit sections UA for each segment (SA5). The analysis processing unit 44 generates the decision tree T[n] for each status St of the probabilistic model M by the machine learning to which each of the unit sections UA is applied (SA6), and generates the variable information D[n] corresponding to the relative pitch R within each of the unit sections UA classified into each of the leaf nodes νc of the decision tree T[n] (SA7). Then, the analysis processing unit 44 stores, on the storage device 14, the singing characteristics data Z including the unit data z[n], which includes the decision tree T[n] generated in Step SA6 and the variable information D[n] generated in Step SA7, for each of the statuses St of the probabilistic model M (SA8). The above-mentioned operation is repeated for each combination of the reference singer (reference voice data XA) and the reference music track data XB, so as to accumulate, on a storage device 54, a plurality of pieces of the singing characteristics data Z corresponding to the mutually different reference singers.

(Voice Synthesis Device 200)

As described above, the voice synthesis device 200 illustrated in FIG. 1 is a signal processing device for generating the voice signal V by the voice synthesis to which the singing characteristics data Z generated by the voice analysis device 100 is applied. As exemplified in FIG. 1, the voice synthesis device 200 is realized by a computer system (for example, information processing device such as a mobile phone or a personal computer) including a processor unit 52, the storage device 54, a display device 56, an input device 57, and a sound emitting device 58.

The display device 56 (for example, liquid crystal display panel) displays an image as instructed by the processor unit 52. The input device 57 is an operation device for receiving an instruction issued to the voice synthesis device 200 by a user, and includes, for example, a plurality of operators to be operated by the user. Note that, a touch panel formed integrally with the display device 56 may be employed as the input device 57. The sound emitting device 58 (for example, speakers and headphones) reproduces, as a sound, the voice signal V generated by the voice synthesis to which the singing characteristics data Z is applied.

The storage device 54 stores programs (GB1, GB2, and GB3) executed by the processor unit 52 and various kinds of data (phonetic piece group YA and synthesis-purpose music track data YB) used by the processor unit 52. A known recording medium such as a semiconductor recording medium or a magnetic recording medium or a combination of a plurality of kinds of recording medium may be arbitrarily employed as the storage device 54. The singing characteristics data Z generated by the voice analysis device 100 is transferred from the voice analysis device 100 to the storage device 54 of the voice synthesis device 200 through the intermediation of, for example, a communication network such as the Internet or a portable recording medium. A plurality of pieces of singing characteristics data Z corresponding to separate reference singers may be stored in the storage device 54.

The storage device 54 according to the first embodiment stores the phonetic piece group YA and the synthesis-purpose music track data YB. The phonetic piece group YA is a set (library for voice synthesis) of a plurality of phonetic pieces used as materials for the concatenative voice synthesis. The phonetic piece is a phoneme (for example, vowel or consonant) serving as a minimum unit for distinguishing a linguistic meaning or a phoneme chain (for example, diphone or triphone) that concatenates a plurality of phonemes. Note that, an utterer of each phonetic piece and the reference singer may be either different or the same. The synthesis-purpose music track data YB expresses a musical notation of a music track (hereinafter referred to as "synthesis-purpose music track") to be subjected to the voice synthesis. Specifically, the synthesis-purpose music track data YB is time-series data (for example, VSQ-format file) for designating the pitch, the pronunciation period, and the lyric for each of the notes forming the synthesis-purpose music track in time series.

The storage device 54 according to the first embodiment stores an editing program GB1, a characteristics giving program GB2, and a voice synthesis program GB3. The editing program GB1 is a program (score editor) for creating and editing the synthesis-purpose music track data YB. The characteristics giving program GB2 is a program for applying the singing characteristics data Z to the voice synthesis, and is provided as, for example, plug-in software for enhancing a function of the editing program GB1. The voice synthesis program GB3 is a program (voice synthesis engine) for generating the voice signal V by executing the voice synthesis. Note that, the characteristics giving program GB2 may also be integrated partially with the editing program GB1 or the voice synthesis program GB3.

The processor unit 52 executes the programs (GB1, GB2, and GB3) stored in the storage device 54 and realizes a plurality of functions (an information editing unit 62, a variable setting unit 64, and a voice synthesis unit 66) for editing the synthesis-purpose music track data YB and for generating the voice signal V. The information editing unit 62 is realized by the editing program GB1, the variable setting unit 64 is realized by the characteristics giving program GB2, and the voice synthesis unit 66 is realized by the voice synthesis program GB3. Note that, a configuration in which the respective functions of the processor unit 52 are distributed to a plurality of devices or a configuration in which a part of the functions of the processor unit 52 is realized by a dedicated electronic circuit (for example, DSP) may also be employed.

Figure 9:
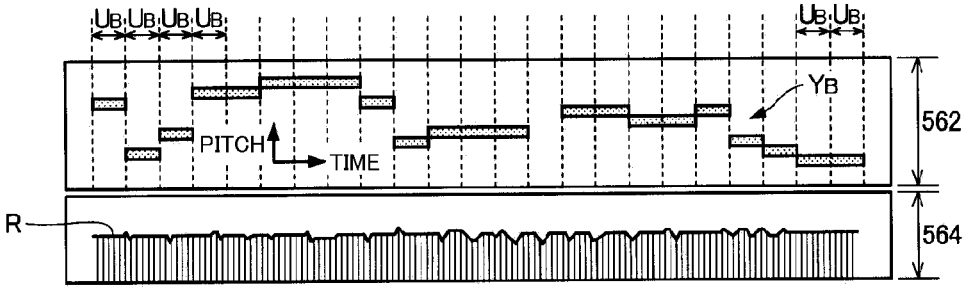
FIG. 9 is a schematic diagram of a musical notation image and a transition image.

The information editing unit 62 edits the synthesis-purpose music track data YB in accordance with an instruction issued through the input device 57 by the user. Specifically, the information editing unit 62 displays a musical notation image 562 illustrated in FIG. 9 representative of the synthesis-purpose music track data YB on the display device 56. The musical notation image 562 is an image (piano roll screen) obtained by arranging pictograms representative of the respective notes designated by the synthesis-purpose music track data YB within an area in which a time axis and a pitch axis are set. The information editing unit 62 edits the synthesis-purpose music track data YB within the storage device 54 in accordance with an instruction issued on the musical notation image 562 by the user.

The user appropriately operates the input device 57 so as to instruct the startup of the characteristics giving program GB2 (that is, application of the singing characteristics data Z) and select the singing characteristics data Z on a desired reference singer from among the plurality of pieces of singing characteristics data Z within the storage device 54. The variable setting unit 64 illustrated in FIG. 1 and realized by the characteristics giving program GB2 sets a time variation (hereinafter referred to as "relative pitch transition") CR of the relative pitch R corresponding to the synthesis-purpose music track data YB generated by the information editing unit 62 and the singing characteristics data Z selected by the user. The relative pitch transition CR is the trace of the relative pitch R of the singing voice obtained by giving the singing style of the singing characteristics data Z to the synthesis-purpose music track designated by the synthesis-purpose music track data YB, and may also be paraphrased as a transition (pitch bend curve on which the singing style of the reference singer is reflected) of the relative pitch R obtained in case where the synthesis-purpose music track of the synthesis-purpose music track data YB is sung by the reference singer.

Specifically, the variable setting unit 64 refers to the synthesis-purpose music track data YB and divides the synthesis-purpose music track into a plurality of unit sections UB on the time axis. Specifically, as understood from FIG. 9, the variable setting unit 64 according to the first embodiment divides the synthesis-purpose music track into the plurality of unit sections UB (for example, sixteenth note) similar to the above-mentioned unit section UA.

Then, the variable setting unit 64 applies each unit section UB to the decision tree T[n] of the unit data z[n] corresponding to the n-th status St of the probabilistic model M within the singing characteristics data Z, to thereby identify one leaf node νc to which the each unit section UB belongs from among K leaf nodes νc of the decision tree T[n], and uses the respective variables ω (ω0, ω1, ω2, and ωd) of the variable group Ω[k] corresponding to the one leaf node νc within the variable information D[n] to identify the time series of the relative pitch R. The above-mentioned processing is successively executed for each of the statuses St of the probabilistic model M, to thereby identify the time series of the relative pitch R within the unit section UB. Specifically, the duration of each status St is set in accordance with the variable cod of the variable group Ω[k], and each relative pitch R is calculated so as to obtain a maximum simultaneous probability of the occurrence probability of the relative pitch R defined by the variable ω0, the occurrence probability of the time variation ΔR of the relative pitch R defined by the variable ω1, and the occurrence probability of the second derivative value $\Delta^2R$ of the relative pitch R defined by the variable ω2. The relative pitch transition CR over the entire range of the synthesis-purpose music track is generated by concatenating the time series of the relative pitch R on the time axis across the plurality of unit sections UB.

The information editing unit 62 adds the relative pitch transition CR generated by the variable setting unit 64 to the synthesis-purpose music track data YB within the storage device 54, and as exemplified in FIG. 9, displays a transition image 564 representative of the relative pitch transition CR on the display device 56 along with the musical notation image 562. The transition image 564 exemplified in FIG. 9 is an image that expresses the relative pitch transition CR as a broken line sharing the time axis with the time series of each of the notes of the musical notation image 562. The user can instruct to change the relative pitch transition CR (each relative pitch R) by using the input device 57 to appropriately change the transition image 564. The information editing unit 62 edits each relative pitch R of the relative pitch transition CR in accordance with an instruction issued by the user.

The voice synthesis unit 66 illustrated in FIG. 1 generates the voice signal V in accordance with the phonetic piece group YA and the synthesis-purpose music track data YB stored in the storage device 54 and the relative pitch transition CR set by the variable setting unit 64. Specifically, in the same manner as the transition generation unit 32 of the variable extraction unit 22, the voice synthesis unit 66 generates the synthesized pitch transition (pitch curve) CP in accordance with the pitch and the pronunciation period designated for each note by the synthesis-purpose music track data YB. The synthesized pitch transition CP is a time series of the pitch PB that continuously fluctuates on the time axis. The voice synthesis unit 66 corrects the synthesized pitch transition CP in accordance with the relative pitch transition CR set by the variable setting unit 64. For example, each relative pitch R of the relative pitch transition CR is added to each pitch PB of the synthesized pitch transition CP. Then, the voice synthesis unit 66 successively selects the phonetic piece corresponding to the lyric for each note from the phonetic piece group YA, and generates the voice signal V by adjusting the respective phonetic pieces to the respective pitches PB of the synthesized pitch transition CP that has been subjected to the correction corresponding to the relative pitch transition CR and concatenating the respective phonetic pieces with each other. The voice signal V generated by the voice synthesis unit 66 is supplied to the sound emitting device 58 to be reproduced as a sound.

The singing style of the reference singer (for example, away of singing, such as expression contours, unique to the reference singer) is reflected on the relative pitch transition CR generated from the singing characteristics data Z, and hence the reproduced sound of the voice signal V corresponding to the synthesized pitch transition CP corrected by the relative pitch transition CR is perceived as the singing voice (that is, such a voice as obtained by the reference singer singing the synthesis-purpose music track) for the synthesis-purpose music track to which the singing style of the reference singer is given.

Figure 10:
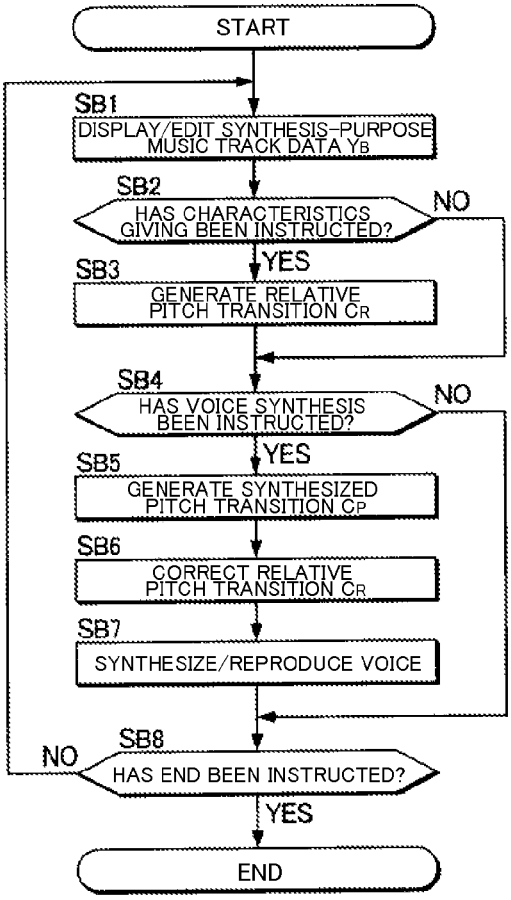
FIG. 10 is a flowchart of an operation of a voice synthesis device.

FIG. 10 is a flowchart of processing executed by the voice synthesis device 200 (processor unit 52) to edit the synthesis-purpose music track data YB and generate the voice signal V. For example, the processing of FIG. 10 is started when the startup (editing of the synthesis-purpose music track data YB) of the editing program GB1 is instructed. When the editing program GB1 is started up, the information editing unit 62 displays the musical notation image 562 corresponding to the synthesis-purpose music track data YB stored in the storage device 54 on the display device 56, and edits the synthesis-purpose music track data YB in accordance with an instruction issued on the musical notation image 562 by the user (SB1).

The processor unit 52 determines whether or not the startup (giving of the singing style corresponding to the singing characteristics data Z) of the characteristics giving program GB2 has been instructed by the user (SB2). When the startup of the characteristics giving program GB2 is instructed (SB2: YES), the variable setting unit 64 generates the relative pitch transition CR corresponding to the synthesis-purpose music track data YB at the current time point and the singing characteristics data Z selected by the user (SB3). The relative pitch transition CR generated by the variable setting unit 64 is displayed on the display device 56 as the transition image 564 in the next Step SB1. On the other hand, when the startup of the characteristics giving program GB2 has not been instructed (SB2: NO), the generation (SB3) of the relative pitch transition CR is not executed. Note that, the relative pitch transition CR is generated above by using the user's instruction as a trigger, but the relative pitch transition CR may also be generated in advance (for example, on the background) irrespective of the user's instruction.

The processor unit 52 determines whether or not the start of the voice synthesis (startup of the voice synthesis program GB3) has been instructed (SB4). When the start of the voice synthesis is instructed (SB4: YES), the voice synthesis unit 66 first generates the synthesized pitch transition CP in accordance with the synthesis-purpose music track data YB at the current time point (SB5). Second, the voice synthesis unit 66 corrects each pitch PB of the synthesized pitch transition CP in accordance with each relative pitch R of the relative pitch transition CR generated in Step SB3 (SB6). Third, the voice synthesis unit 66 generates the voice signal V by adjusting the phonetic pieces corresponding to the lyrics designated by the synthesis-purpose music track data YB within the phonetic piece group YA to the respective pitches PB of the synthesized pitch transition CP subjected to the correction in Step SB6 and concatenating the respective phonetic pieces with each other (SB7). When the voice signal V is supplied to the sound emitting device 58, the singing voice for the synthesis-purpose music track to which the singing style of the reference singer is given is reproduced. On the other hand, when the start of the voice synthesis has not been instructed (SB4: NO), the processing from Step SB5 to Step SB7 is not executed. Note that, the generation of the synthesized pitch transition CP (SB5), the correction of each pitch PB (SB6), and the generation of the voice signal V (SB7) may be executed in advance (for example, on the background) irrespective of the user's instruction.

The processor unit 52 determines whether or not the end of the processing has been instructed (SB8). When the end has not been instructed (SB8: NO), the processor unit 52 returns the processing to Step SB1 to repeat the above-mentioned processing. On the other hand, when the end of the processing is instructed (SB8: YES), the processor unit 52 brings the processing of FIG. 10 to an end.

As described above, in the first embodiment, the relative pitch R corresponding to a difference between each pitch PB of the synthesized pitch transition CP generated from the reference music track data XB and each pitch PA of the reference voice is used to generate the singing characteristics data Z on which the singing style of the reference singer is reflected. Therefore, compared to a configuration in which the singing characteristics data Z is generated in accordance with the time series of the pitch PA of the reference voice, it is possible to reduce a necessary probabilistic model (number of variable groups Ω[k] within the variable information D[n]). Further, the respective pitches PA of the synthesized pitch transition CP are continuous on the time axis, which is also advantageous in that, as described below in detail, a discontinuous fluctuation of the relative pitch Rat a time point of the boundary between the respective notes that are different in pitch is suppressed.

Figure 11:
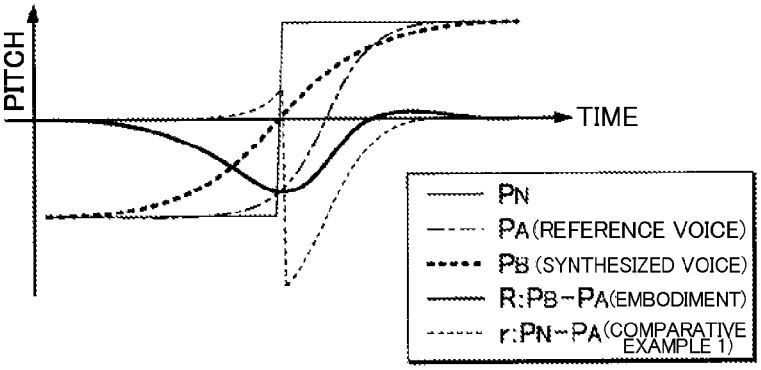
FIG. 11 is an explanatory diagram of an effect of the first embodiment.

FIG. 11 is a schematic diagram that collectively indicates a pitch PN (note number) of each note designated by the reference music track data XB, the pitch PA of the reference voice expressed by the reference voice data XA, the pitch PB (synthesized pitch transition CP) generated from the reference music track data XB, and the relative pitch R calculated by the variable extraction unit 22 according to the first embodiment in accordance with the pitch PB and the pitch PA. In FIG. 11, a relative pitch r calculated in accordance with the pitch PN of each note and the pitch PA of the reference voice is indicated as Comparative Example 1. A discontinuous fluctuation occurs in the relative pitch r according to Comparative Example 1 at the time point of the boundary between the notes, while it is clearly confirmed from FIG. 11 that the relative pitch R according to the first embodiment continuously fluctuate even at the time point of the boundary between the notes. As described above, there is an advantage in that the synthesized voice that sounds auditorily natural is generated by using the relative pitch R that temporally continuously fluctuates.

Further, in the first embodiment, the voiceless section σ0 from which the pitch PA of the reference voice is not detected is refilled with a significant pitch PA. That is, the time length of the voiceless section σ0 of the reference voice in which the pitch PA does not exist is shortened. Therefore, it is possible to effectively suppress the discontinuous fluctuation of the relative pitch R within a voiced section other than a voiceless section νX of the reference music track (the synthesized voice) designated by the reference music track data XB. Particularly in the first embodiment, the pitch PA within the voiceless section ν0 is approximately set in accordance with the pitches PA within the voiced sections (σ1 and σ2) before and after the voiceless section σ0, and hence the above-mentioned effect of suppressing the discontinuous fluctuation of the relative pitch R is remarkable. Note that, as understood from FIG. 4, even in the first embodiment in which the voiceless section σ0 of the reference voice is refilled with the pitch PA, the relative pitch R may discontinuously fluctuate within the voiceless section σX (within the interval between the interpolation section ηA2 and the interpolation section ηB2). However, the relative pitch R may discontinuously fluctuate within the voiceless section σX in which the pitch of the voice is not perceived, and an influence of discontinuity of the relative pitch R regarding the singing voice for the synthesis-purpose music track is sufficiently suppressed.

Note that, in the first embodiment, the respective unit sections U (UA or UB) obtained by dividing the reference music track or the synthesis-purpose music track for each unit of segment are expressed by one probabilistic model M, but it is also conceivable to employ a configuration (hereinafter referred to as "Comparative Example 2") in which one note is expressed by one probabilistic model M. However, in Comparative Example 2, the notes are expressed by a mutually equal number of statuses St irrespective of the duration, and hence it is difficult to precisely express the singing style of the reference voice for the note having a long duration by the probabilistic model M. In the first embodiment, one probabilistic model M is given to the respective unit sections U (UA or UB) obtained by dividing the music track for each unit of segment. In the above-mentioned configuration, as the note has a longer duration, a total number of statuses St of the probabilistic model M that expresses the note increases. Therefore, compared to Comparative Example 2, there is an advantage in that the relative pitch R is controlled with precision irrespective of a length of the duration.

Second Embodiment

A second embodiment of the present invention is described below. Note that, components of which operations and functions are the same as those of the first embodiment in each of the embodiments exemplified below are denoted by the same reference numerals referred to in the description of the first embodiment, and a detailed description of each thereof is omitted appropriately.

Figure 12:
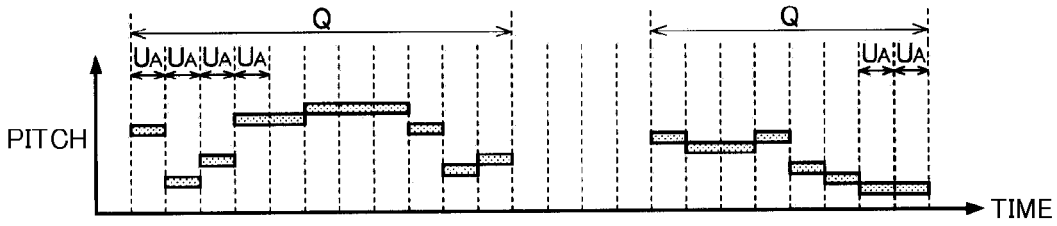
FIG. 12 is an explanatory diagram of phrases according to a second embodiment of the present invention.

FIG. 12 is an explanatory diagram of the second embodiment. As exemplified in FIG. 12, in the same manner as in the first embodiment, the section setting unit 42 of the voice analysis device 100 according to the second embodiment divides the reference music track into the plurality of unit sections UA, and also divides the reference music track into a plurality of phrases Q on the time axis. The phrase Q is a section of a melody (time series of a plurality of notes) perceived by a listener as a musical chunk within the reference music track. For example, the section setting unit 42 divides the reference music track into the plurality of phrases Q by using the silent section (for example, silent section equal to or longer than a quarter rest) exceeding a predetermined length as a boundary.

The decision tree T[n] generated for each status St by the analysis processing unit 44 according to the second embodiment includes nodes ν for which conditions relating to a relationship between respective unit sections UA and the phrase Q including the respective unit sections UA are set. Specifically, it is determined at each internal node νb (or root node νa) whether or not the condition relating to the relationship between a note within the unit section U and each of the notes within the phrase Q is successful, as exemplified below:

whether or not the note within the unit section UA is located on the start point side within the phrase Q;

whether or not the note within the unit section UA is located on the end point side within the phrase Q;

whether or not a distance between the note within the unit section UA and the highest sound within the phrase Q exceeds a predetermined value;

whether or not a distance between the note within the unit section UA and the lowest sound within the phrase Q exceeds a predetermined value; and whether or not a distance between the note within the unit section UA and the most frequent sound within the phrase Q exceeds a predetermined value.

The "distance" in each of the above-mentioned conditions may be both a distance on the time axis (time difference) and a distance on the pitch axis (pitch difference), and when a plurality of notes within the phrase Q are concerned, for example, it may be the shortest distance from the note within the unit section UA. Further, the "most frequent sound" means a note having the maximum number of times of pronunciation within the phrase Q or a pronunciation time (or a value obtained by multiplying both)

The variable setting unit 64 of the voice synthesis device 200 divides the synthesis-purpose music track into the plurality of unit sections UB in the same manner as in the first embodiment, and further divides the synthesis-purpose music track into the plurality of phrases Q on the time axis. Then, as described above, the variable setting unit 64 applies each unit section UB to a decision tree in which the condition relating to the phrase Q is set for each of the nodes ν, to thereby identify one leaf node νc to which the each unit section UB belongs.

The second embodiment also realizes the same effect as that of the first embodiment. Further, in the second embodiment, the condition relating to a relationship between the unit section U (UA or UB) and the phrase Q is set for each node ν of the decision tree T[n]. Accordingly, it is advantageous in that it is possible to generate the synthesized voice that sounds auditorily natural in which the relationship between the note of each unit section U and each note within the phrase Q is taken into consideration.

Third Embodiment

The variable setting unit 64 of the voice synthesis device 200 according to a third embodiment of the present invention generates the relative pitch transition CR in the same manner as in the first embodiment, and further sets a control variable applied to the voice synthesis performed by the voice synthesis unit 66 to be variable in accordance with each relative pitch R of the relative pitch transition CR. The control variable is a variable for controlling a musical expression to be given to the synthesized voice. For example, a variable such as a velocity of the pronunciation or a tone (for example, clearness) is preferred as the control variable, but in the following description, the dynamics Dyn is exemplified as the control variable.

Figure 13:
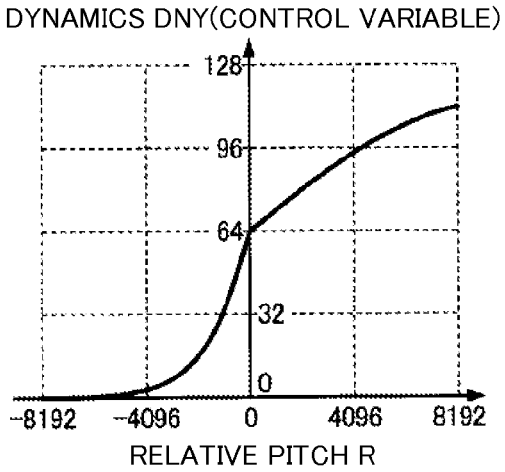
FIG. 13 is a graph showing a relationship between a relative pitch and a control variable according to a third embodiment of the present invention.

FIG. 13 is a graph exemplifying a relationship between each relative pitch R of the relative pitch transition CR and dynamics Dyn. The variable setting unit 64 sets the dynamics Dyn so that the relationship illustrated in FIG. 13 is established for each relative pitch R of the relative pitch transition CR.

As understood from FIG. 13, the dynamics Dyn roughly increases as the relative pitch R becomes higher. When the pitch of the singing voice is lower than an original pitch of the music track (when the relative pitch R is a negative number), the singing tends to be perceived as poor more often than when the pitch of the singing voice is higher (when the relative pitch R is a positive number). In consideration of the above-mentioned tendency, as exemplified in FIG. 13, the variable setting unit 64 sets the dynamics Dyn in accordance with the relative pitch R so that a ratio (absolute value of inclination) of a decrease in the dynamics Dyn to a decrease in the relative pitch R within the range of a negative number exceeds a ratio of an increase in the dynamics Dyn to an increase in the relative pitch R within the range of a positive number. Specifically, the variable setting unit 64 calculates the dynamics Dyn ($0 \leq Dyn \leq 127$) by Expression (A) exemplified below.

$$Dyn = \tan h(R \times \beta / 8192) \times 64 + 64 \quad (A)$$

A coefficient β of Expression (A) is variable for causing the ratio of a change in the dynamics Dyn to the relative pitch R to differ between a positive side and a negative side of the relative pitch R. Specifically, the coefficient β is set to four when the relative pitch R is a negative number, and set to one when the relative pitch R is a non-negative number (zero or a positive number). Note that, the numerical value of the coefficient β and contents of Expression (A) are merely examples for the sake of convenience, and may be changed appropriately.

The third embodiment also realizes the same effect as that of the first embodiment. Further, in the third embodiment, the control variable (dynamics Dyn) is set in accordance with the relative pitch R, which is advantageous in that the user does not need to manually set the control variable. Note that, the control variable (dynamics Dyn) is set in accordance with the relative pitch R in the above description, but the time series of the numerical value of the control variable may be expressed by, for example, a probabilistic model. Note that, the configuration of the second embodiment may be employed for the third embodiment.

Fourth Embodiment

Figure 14:
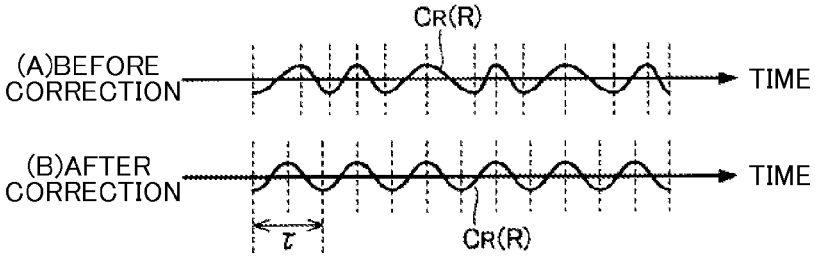
FIG. 14 is an explanatory diagram of a correction of the relative pitch according to a fourth embodiment of the present invention.

When the condition for each node ν of the decision tree T[n] is appropriately set, a temporal fluctuation of the relative pitch R on which the characteristics of a vibrato of the reference voice has been reflected appears in the relative pitch transition CR corresponding to the singing characteristics data Z. However, when generating the relative pitch transition CR using the singing characteristics data Z, a periodicity of the fluctuation of the relative pitch R is not always guaranteed, and hence, as exemplified in part (A) of FIG. 14, each relative pitch R of the relative pitch transition CR may fluctuate irregularly in the section within the music track to which the vibrato is to be given. In view of the above-mentioned circumstances, the variable setting unit 64 of the voice synthesis device 200 according to a fourth embodiment of the present invention corrects the fluctuation of the relative pitch R ascribable to the vibrato within the synthesis-purpose music track to a periodic fluctuation.

Figure 15:
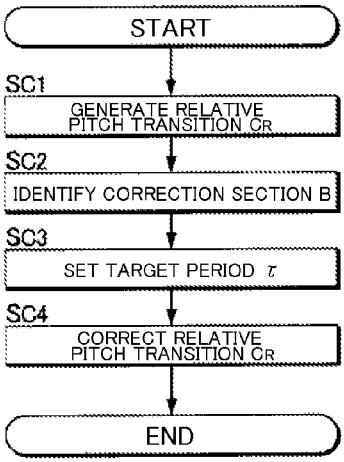
FIG. 15 is a flowchart of an operation of a variable setting unit according to the fourth embodiment.

FIG. 15 is a flowchart of an operation of the variable setting unit 64 according to the fourth embodiment. Step SB3 of FIG. 10 according to the first embodiment is replaced by Step SC1 to Step SC4 of FIG. 15. When the processing of FIG. 15 is started, the variable setting unit 64 generates the relative pitch transition CR by the same method as that of the first embodiment (SC1), and identifies a section (hereinafter referred to as "correction section") B corresponding to the vibrato within the relative pitch transition CR (SC2).

Specifically, the variable setting unit 64 calculates a zero-crossing number of the derivative value ΔR of the relative pitch R of the relative pitch transition CR. The zero-crossing number of the derivative value ΔR of the relative pitch R corresponds to a total number of crest parts (maximum points) and trough parts (minimum points) on the time axis within the relative pitch transition CR. In the section in which the vibrato is given to the singing voice, the relative pitch R tends to fluctuate alternately between a positive number and a negative number at a suitable frequency. In consideration of the above-mentioned tendency, the variable setting unit 64 identifies a section in which the zero-crossing number (that is, the number of crest parts and trough parts within a unit time) of the derivative value ΔR within a unit time falls within a predetermined range, as the correction section B. However, a method of identifying the correction section B is not limited to the above-mentioned example. For example, a second half section of the note that exceeds a predetermined length (that is, section to which the vibrato is likely to be given) among the plurality of notes designated by the synthesis-purpose music track data YB may be identified as the correction section B When the correction section B is identified, the variable setting unit 64 sets a period (hereinafter referred to as "target period") τ of the corrected vibrato (SC3). The target period τ is, for example, a numerical value obtained by dividing the time length of the correction section B by the number (wave count) of crest parts or trough parts of the relative pitch R within the correction section B. Then, the variable setting unit 64 corrects each relative pitch R of the relative pitch transition CR so that the interval between the respective crest parts (or respective trough parts) of the relative pitch transition CR within the correction section B is closer to (ideally, matches) the target period τ (SC4). As understood from the above description, the intervals between the crest parts and the trough parts are non-uniform in the relative pitch transition CR before the correction as shown in part (A) of FIG. 14, while the intervals between the crest parts and the trough parts become uniform in the relative pitch transition CR after the correction of Step SC4 as shown in part (B) of FIG. 14.

The fourth embodiment also realizes the same effect as that of the first embodiment. Further, in the fourth embodiment, the intervals between the crest parts and the trough parts of the relative pitch transition CR on the time axis become uniform. Accordingly it is advantageous in that the synthesized voice to which an auditorily natural vibrato has been given is generated. Note that, the correction section B and the target period τ are set automatically (that is, irrespective of the user's instruction) in the above description, but the characteristics (section, period, or amplitude) of the vibrato may also be set variably in accordance with an instruction issued by the user. Further, the configuration of the second embodiment or the third embodiment may be employed for the fourth embodiment.

Fifth Embodiment

Figure 16:
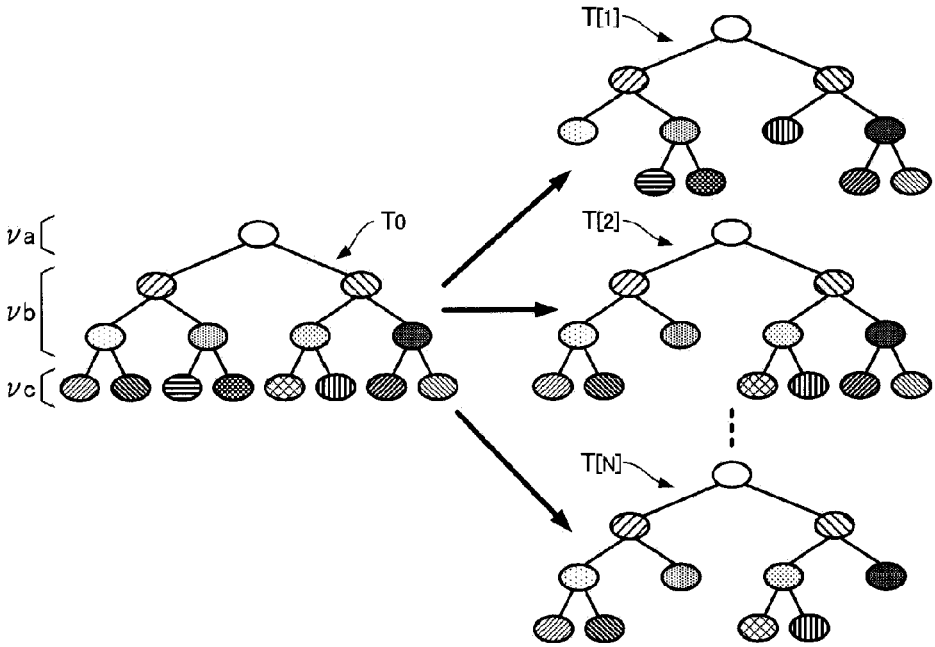
FIG. 16 is an explanatory diagram of generation of a decision tree according to a fifth embodiment of the present invention.

In the first embodiment, the decision tree T[n] independent for each of the statuses St of the probabilistic model M has been taken as an example. As understood from FIG. 16, the characteristics analysis unit 24 (analysis processing unit 44) of the voice analysis device 100 according to a fifth embodiment of the present invention generates the decision trees T[n] (T[1] to T[N]) for each status St from a single decision tree (hereinafter referred to as "basic decision tree") T0 common across N statuses St of the probabilistic model M. Therefore, presence/absence of the internal node νb or the leaf node νc differs between the respective decision trees T[n] (therefore, the number K of leaf nodes νc differs between the respective decision trees T[n] in the same manner as in the first embodiment), but contents of the conditions for the respective internal nodes νb corresponding to each other in the respective decision trees T[ n] are common. Note that, in FIG. 16, the respective nodes ν that share the condition are illustrated in the same manner (hatching).

Figure 17:
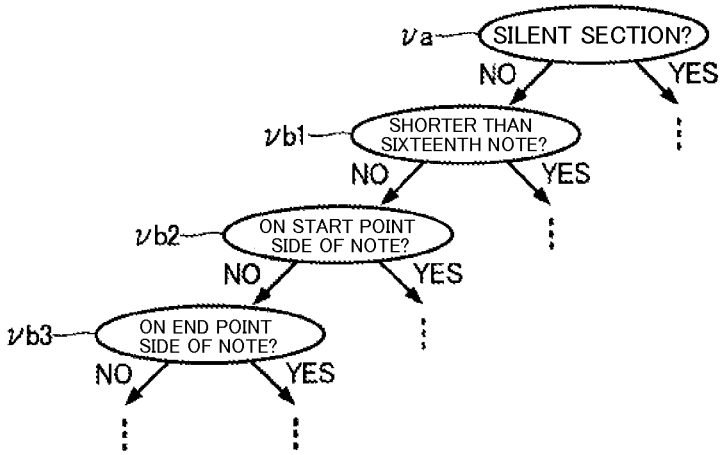
FIG. 17 is an explanatory diagram of common conditions for the decision tree according to the fifth embodiment.

As described above, in the fifth embodiment, N decision trees T[1] to T[N] are derivatively generated from the common basic decision tree T0 serving as an origin, and hence conditions (hereinafter referred to as "common conditions") set for the respective nodes ν (root node νa and internal node νb) located on an upper layer are common across the N decision trees T[1] to T[N]. FIG. 17 is a schematic diagram of the tree structure common across the N decision trees T[1] to T[N]. It is determined at the root node νa whether or not the unit section U (UA or UB) is a silent section in which a note does not exist. At an internal node νb1 followed after the determination at the root node νa results in NO, it is determined whether or not the note within the unit section U is shorter than the sixteenth note. At an internal node νb2 followed after the determination at the internal node νb1 results in NO, it is determined whether or not the unit section U is located on the start point side of the note. At an internal node νb3 followed after the determination at the internal node νb2 results in NO, it is determined whether or not the unit section U is located on the end point side of the note. Each of the conditions (common conditions) for the root node νa and the plurality of internal nodes νb (νb1 to νb3) described above is common across the N decision trees T[1] to T[N].

The fifth embodiment also realizes the same effect as that of the first embodiment. Where the decision trees T[n] are generated completely independently for the respective statuses St of the probabilistic model M, the characteristics of the time series of the relative pitch R within the unit section U may differ between the statuses St before and after, with the result that the synthesized voice may be the voice that gives an impression of sounding unnatural (for example, voice that cannot be pronounced in actuality or voice different from an actual pronunciation). In the fifth embodiment, the N decision trees T[1] to T[N] corresponding to the mutually different statuses St of the probabilistic model M are generated from the common basic decision tree T0. Thus, it is advantageous in that, compared to a configuration in which each of the N decision trees T[1] to T[N] is generated independently, a possibility that the characteristics of the transition of the relative pitch R excessively differs between adjacent statuses St is reduced, and the synthesized voice that sounds auditorily natural (for example, voice that can be pronounced in actuality) is generated. It should be understood that a configuration in which the decision tree T[n] is generated independently for each of the statuses St of the probabilistic model M may be included within the scope of the present invention.

Note that, in the above description, the configuration in which the decision trees T[n] of the respective statuses St are partially common has been taken as an example, but all the decision trees T[n] of the respective statuses St may also be common (the decision trees T[n] are completely common among the statuses St). Further, the configuration of any one of the second embodiment to the fourth embodiment may be employed for the fifth embodiment.

Sixth Embodiment

In the above-mentioned embodiments, a case where the decision trees T[n] are generated by using the pitch PA detected from the reference voice for one reference music track has been taken as an example for the sake of convenience, but in actuality, the decision trees T[n] are generated by using the pitches PA detected from the reference voices for a plurality of mutually different reference music tracks. In the configuration in which the respective decision trees T[n] are generated from a plurality of reference music tracks as described above, the plurality of unit sections UA included in the mutually different reference music tracks can be classified into one leaf node νc of the decision tree T[n] in a coexisting state and may be used for the generation of the variable group Ω[k] of the one leaf node νc. On the other hand, in a scene in which the relative pitch transition CR is generated by the variable setting unit 64 of the voice synthesis device 200, the plurality of unit sections UB included in one note within the synthesis-purpose music track are classified into the mutually different leaf nodes νc of the decision trees T[n]. Therefore, tendencies of the pitches PA of the mutually different reference music tracks may be reflected on each of the plurality of unit sections UB corresponding to one note of the synthesis-purpose music track, and the synthesized voice (in particular, characteristics of the vibrato or the like) may be perceived to give the impression of sounding auditorily unnatural.

In view of the above-mentioned circumstances, in a sixth embodiment of the present invention, the characteristics analysis unit 24 (analysis processing unit 44) of the voice analysis device 100 generates the respective decision trees T[n] so that each of the plurality of unit sections UB included in one note (note corresponding to a plurality of segments) within the synthesis-purpose music track is classified into each of the leaf nodes νc corresponding to the common reference music within the decision trees T[n] (that is, leaf node νc into which only the unit section UB within the reference music track is classified when the decision tree T[n] is generated).

Specifically, in the sixth embodiment, the condition (context) set for each internal node νb of the decision tree T[n] is divided into two kinds of a note condition and a section condition. The note condition is a condition (condition relating to an attribute of one note) to determine success/failure for one note as a unit, while the section condition is a condition (condition relating to an attribute of one unit section U) to determine success/failure for one unit section U (UA or UB) as a unit.

Specifically, the note condition is exemplified by the following conditions (A1 to A3).

A1: condition relating to the pitch or the duration of one note including the unit section U A2: condition relating to the pitch or the duration of the note before and after one note including the unit section U A3: condition relating to a position (position on the time axis or the pitch axis) of one note within the phrase Q Condition A1 is, for example, a condition as to whether the pitch or the duration of one note including the unit section U falls within a predetermined range. Condition A2 is, for example, a condition as to whether the pitch difference between one note containing the unit section U and a note immediately before or immediately after the one note falls within a predetermined range. Further, Condition A3 is, for example, a condition as to whether one note containing the unit section U is located on the start point side of the phrase Q or a condition as to whether the one note is located on the end point side of the phrase Q.

On the other hand, the section condition is, for example, a condition relating to the position of the unit section U relative to one note. For example, a condition as to whether or not the unit section U is located on the start point side of a note or a condition as to whether or not the unit section U is located on the end point side of the note is preferred as the section condition.

Figure 18:
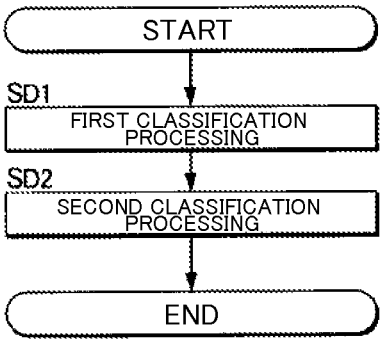
FIG. 18 is a flowchart of an operation of a characteristics analysis unit according to a sixth embodiment of the present invention.
Figure 19:
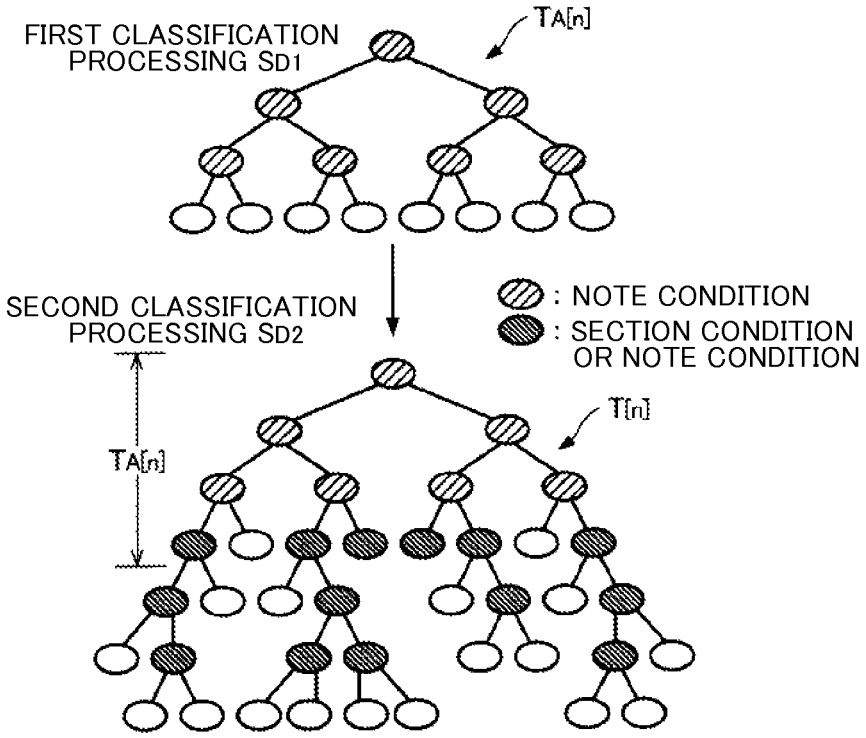
FIG. 19 is an explanatory diagram of generation of a decision tree according to the sixth embodiment.

FIG. 18 is a flowchart of processing for generating the decision tree T[n] performed by the analysis processing unit 44 according to the sixth embodiment. Step SA6 of FIG. 8 according to the first embodiment is replaced by the respective processing illustrated in FIG. 18. As exemplified in FIG. 18, the analysis processing unit 44 generates the decision tree T[n] by classifying each of the plurality of unit sections UA defined by the section setting unit 42 in two stages of a first classification processing SD1 and a second classification processing SD2. FIG. 19 is an explanatory diagram of the first classification processing SD1 and the second classification processing SD2.

The first classification processing SD1 is processing for generating a temporary decision tree (hereinafter referred to as "temporary decision tree") TA[n] of FIG. 19 by using the above-mentioned note condition. As understood from FIG. 19, the section condition is not used for generating a temporary decision tree TA[n]. Therefore, the plurality of unit sections UA included in the common reference music track tend to be classified into one leaf node νc of the temporary decision tree TA[n]. That is, a possibility that the plurality of unit sections UA corresponding to the mutually different reference music tracks may be mixedly classified into one leaf node νc is reduced.

The second classification processing SD2 is processing for further branching the respective leaf nodes νc of the temporary decision tree TA[n] by using the above-mentioned section condition, to thereby generate the final decision tree T[n]. Specifically, as understood from FIG. 19, the analysis processing unit 44 according to the sixth embodiment generates the decision tree T[n] by classifying the plurality of unit sections UA classified into each of the leaf nodes νc of the temporary decision tree TA[n] by a plurality of conditions including both the section condition and the note condition. That is, each of the leaf nodes νc of the temporary decision tree TA[n] may correspond to the internal node νb of the decision tree T[n]. As understood from the above description, the analysis processing unit 44 generates the decision tree T[n] having a tree structure in which the plurality of internal nodes νb, to which only the note condition is set, are arranged, in the upper layer of the plurality of internal nodes νb in which the section condition and the note condition are set. The plurality of unit sections UA within the common reference music track are classified into one leaf node νc of the temporary decision tree TA[n], and hence the plurality of unit sections UA within the common reference music track are also classified into one leaf node νc of the decision tree T[n] generated by the second classification processing SD2. The analysis processing unit 44 according to the sixth embodiment operates as described above. The sixth embodiment is the same as the first embodiment in that the variable group Ω[k] is generated from the relative pitches R of the plurality of unit sections UA classified into one leaf node νc.

On the other hand, in the same manner as in the first embodiment, the variable setting unit 64 of the voice synthesis device 200 applies the respective unit sections UB obtained by dividing the synthesis-purpose music track designated by the synthesis-purpose music track data YB to each decision tree T[n] generated by the above-mentioned procedure, to thereby classify the respective unit sections UB into one leaf node νc, and generates the relative pitch R of the unit section UB in accordance with the variable group Ω[k] corresponding to the one leaf node νc. As described above, the note condition is determined preferentially to the section condition in the decision tree T[n], and hence each of the plurality of unit sections UB included in one note of the synthesis-purpose music track is classified into each leaf node νc into which only each unit section UA of the common reference music track is classified when the decision tree T[n] is generated. That is, the variable group Ω[k] corresponding to the characteristics of the reference voice for the common reference music track is applied for generating the relative pitch R within the plurality of unit sections UB included in one note of the synthesis-purpose music track. Therefore, there is an advantage in that the synthesized voice that gives the impression of sounding auditorily natural is generated compared to the configuration in which the decision tree T[n] is generated without distinguishing the note condition from the section condition.

The configurations of the second embodiment to the fifth embodiment are applied to the sixth embodiment in the same manner. Note that, when the configuration of the fifth embodiment in which the condition for the upper layer of the decision tree T[n] is fixed is applied to the sixth embodiment, irrespective of which of the note condition and the section condition is concerned, the common condition of the fifth embodiment is fixedly set in the upper layer of the tree structure, and the note condition or the section condition is set for each node ν located in a lower layer of each node ν for which the common condition is set by the same method as that of the sixth embodiment.

Seventh Embodiment

Figure 20:
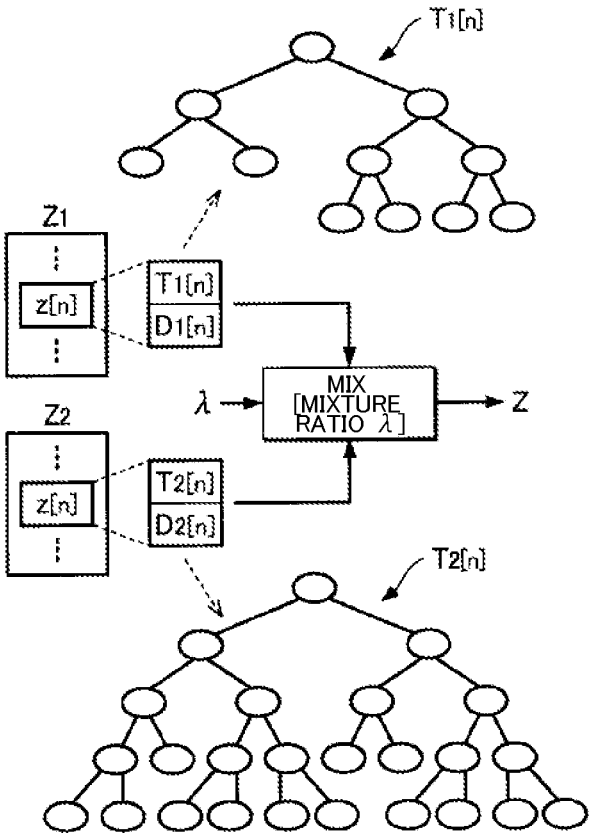
FIG. 20 is a flowchart of an operation of a variable setting unit according to a seventh embodiment of the present invention.

FIG. 20 is an explanatory diagram of an operation of a seventh embodiment of the present invention. The storage device 54 of the voice synthesis device 200 according to the seventh embodiment stores a singing characteristics data Z1 and a singing characteristics data Z2 in which the reference singer is common. An arbitrary piece of unit data z[n] of the singing characteristics data Z1 includes a decision tree T1[n] and variable information D1[n], and an arbitrary piece of unit data z[n] of the singing characteristics data Z2 includes a decision tree T2[n] and variable information D2[n]. The decision tree T1[n] and the decision tree T2[n] are tree structures generated from the common reference voice, but as understood from FIG. 20, are different in size (number of tiers of the tree structure or total number of nodes ν). Specifically, the size of the decision tree T1[n] is smaller than the size of the decision tree T2[n]. For example, when the decision tree T[n] is generated by the characteristics analysis unit 24, the tree structure is stopped from branching by the mutually different conditions, to thereby generate the decision tree T1[n] and the decision tree T2[n] that are different in size. Note that, not only when the condition for stopping the tree structure from branching differs, but also when the contents or an arrangement (question set) of the conditions set for the respective nodes ν differs (for example, the condition relating to the phrase Q is not included in one of them), the decision tree T1[n] and the decision tree T2[n] may differ in size or structure (the contents or the arrangement of the conditions set for each node ν).

When the decision tree T1[n] is generated, a large number of unit sections U are classified into one leaf node νc, and the characteristics are leveled, which gives superiority to the singing characteristics data Z1 in that the relative pitch R is stably generated for a variety of synthesis-purpose music track data YB compared to the singing characteristics data Z2. On the other hand, the classification of the unit sections U is fragmented in the decision tree T2[n], which gives superiority to the singing characteristics data Z2 in that a fine feature of the reference voice is expressed by the probabilistic model M compared to the singing characteristics data Z1.

By appropriately operating the input device 57, the user not only can instruct the voice synthesis (generation of the relative pitch transition CR) using each of the singing characteristics data Z1 and the singing characteristics data Z2, but also can instruct to mix the singing characteristics data Z1 and the singing characteristics data Z2. When the mixing of the singing characteristics data Z1 and the singing characteristics data Z2 is instructed, as exemplified in FIG. 20, the variable setting unit 64 according to the seventh embodiment mixes the singing characteristics data Z1 and the singing characteristics data Z2, to thereby generate the singing characteristics data Z that indicates an intermediate singing style between both. That is, the probabilistic model M defined by the singing characteristics data Z1 and the probabilistic model M defined by the singing characteristics data Z2 are mixed (interpolated). The singing characteristics data Z1 and the singing characteristics data Z2 are mixed with a mixture ratio λ designated by the user operating the input device 57. The mixture ratio λ means a contribution degree of the singing characteristics data Z1 (or singing characteristics data Z2) relative to the singing characteristics data Z after the mixing, and is set, for example, within a range equal to or greater than zero and equal to or smaller than one. Note that, interpolation of each probabilistic model M is taken as an example in the above description, but it is also possible to extrapolate the probabilistic model M defined by the singing characteristics data Z1 and the probabilistic model M defined by the singing characteristics data Z2.

Specifically, the variable setting unit 64 generates the singing characteristics data Z by interpolating (for example, interpolating the average and distribution of the probability distribution) the probability distribution defined by the variable group Ω[k] of the mutually corresponding leaf nodes νc between the decision tree T1[n] of the singing characteristics data Z1 and the decision tree T2[n] of the singing characteristics data Z2 in accordance with the mixture ratio λ. The generation of the relative pitch transition CR using the singing characteristics data Z and other such processing is the same as those of the first embodiment. Note that, the interpolation of the probabilistic model M defined by the singing characteristics data Z is also described in detail in, for example, M. Tachibana, et al., "Speech Synthesis with Various Emotional Expressions and Speaking Styles by Style Interpolation and Morphing", IEICE TRANS. Information and Systems, E88-D, No. 11, p. 2484-2491, 2005.

Note that, it is also possible to employ back-off smoothing for dynamic size adjustment at a time of synthesizing the decision tree T[n]. However, the configuration in which the probabilistic model M is interpolated without using the back-off smoothing is advantageous in that there is no need to cause the tree structure (condition or arrangement of respective nodes ν) to be common between the decision tree T1[n] and the decision tree T2[n], and is advantageous in that the probability distribution of the leaf node νc is interpolated (there is no need to consider a statistic of the internal node νb), resulting in a reduced arithmetic operation load. Note that, the back-off smoothing is also described in detail in, for example, Kataoka and three others, "Decision-Tree Backing-off in HMM-Based Speech Synthesis", Corporate Juridical Person, The Institute of Electronics, Information and Communication Engineers, TECHNICAL REPORT OF IEICE SP2003-76 (2003-08).

The seventh embodiment also realizes the same effect as that of the first embodiment. Further, in the seventh embodiment, the mixing of the singing characteristics data Z1 and the singing characteristics data Z2 is followed by generating the singing characteristics data Z that indicates the intermediate singing style between both, which is advantageous in that the synthesized voice in a variety of singing styles is generated compared to a configuration in which the relative pitch transition CR is generated solely by using the singing characteristics data Z1 or the singing characteristics data Z2. Note that, the configurations of the second embodiment to the sixth embodiment may be applied to the seventh embodiment in the same manner.

Modification Example

Each of the embodiments exemplified above may be changed variously. Embodiments of specific changes are exemplified below. It is also possible to appropriately combine at least two embodiments selected arbitrarily from the following examples.

(1) In each of the above-mentioned embodiments, the relative pitch transition CR (pitch bend curve) is calculated from the reference voice data XA and the reference music track data XB that are provided in advance for the reference music track, but the variable extraction unit 22 may acquire the relative pitch transition CR by an arbitrary method. For example, the relative pitch transition CR estimated from an arbitrary reference voice by using a known singing analysis technology may also be acquired by the variable extraction unit 22 and applied to the generation of the singing characteristics data Z performed by the characteristics analysis unit 24. As the singing analysis technology used to estimate the relative pitch transition CR (pitch bend curve) for example, it is preferable to use a technology disclosed in T. Nakano and M. Goto, VOCALISTENER 2: A SINGING SYNTHESIS SYSTEM ABLE TO MIMIC A USER'S SINGING IN TERMS OF VOICE TIMBRE CHANGES AS WELL AS PITCH AND DYNAMICS", In Proceedings of the 36th International Conference on Acoustics, Speech and Signal Processing (ICASSP2011), p. 453-456, 2011.

(2) In each of the above-mentioned embodiments, the concatenative voice synthesis for generating the voice signal V by concatenating phonetic pieces with each other has been taken as an example, but a known technology is arbitrarily employed for generating the voice signal V. For example, the voice synthesis unit 66 generates a basic signal (for example, sinusoidal signal indicating an utterance sound of a vocal cord) adjusted to each pitch PB of the synthesized pitch transition CP to which the relative pitch transition CR generated by the variable setting unit 64 is added, and executes filter processing (for example, filter processing for approximating resonance inside an oral cavity) corresponding to the phonetic piece of the lyric designated by the synthesis-purpose music track data YB for the basic signal, to thereby generate the voice signal V.

(3) As described above in the first embodiment, the user of the voice synthesis device 200 can instruct to change the relative pitch transition CR by appropriately operating the input device 57. The instruction to change the relative pitch transition CR may also be reflected on the singing characteristics data Z stored in the storage device 14 of the voice analysis device 100.

(4) In each of the above-mentioned embodiments, the relative pitch R has been taken as an example of the feature amount of the reference voice, but the configuration in which the feature amount is the relative pitch R is not essential to a configuration (for example, configuration characterized in the generation of the decision tree T[n]) that is not premised on an intended object of suppressing the discontinuous fluctuation of the relative pitch R. For example, the feature amount acquired by the variable extraction unit 22 is not limited to the relative pitch R in the configuration of the first embodiment in which the music track is divided into the plurality of unit sections U (UA or UB) for each segment, in the configuration of the second embodiment in which the phrase Q is taken into consideration of the condition for each node ν, in the configuration of the fifth embodiment in which N decision trees T[1] to T[N] are generated from the basic decision tree T0, in the configuration of the sixth embodiment in which the decision tree T[n] is generated in the two stages of the first classification processing SD1 and the second classification processing SD2, or in the configuration of the seventh embodiment in which the plurality of pieces of singing characteristics data Z are mixed. For example, the variable extraction unit 22 may also extract the pitch PA of the reference voice, and the characteristics analysis unit 24 may also generate the singing characteristics data Z that defines the probabilistic model M corresponding to the time series of the pitch PA.

A voice analysis device according to each of the above-mentioned embodiments is realized by hardware (electronic circuit) such as a digital signal processor (DSP) dedicated to processing for a sound signal, and is also realized in cooperation between a general-purpose processor unit such as a central processing unit (CPU) and a program. The program according to the present invention may be installed on a computer by being provided in a form of being stored in a computer-readable recording medium. The recording medium is, for example, a non-transitory recording medium, whose preferred examples include an optical recording medium (optical disc) such as a CD-ROM, and may include a known recording medium of an arbitrary format such as a semiconductor recording medium or a magnetic recording medium. Further, for example, the program according to the present invention may be installed on the computer by being provided in a form of being distributed through the communication network. Further, the present invention is also defined as an operation method (voice analysis method) for the voice analysis device according to each of the above-mentioned embodiments.

What is claimed is:

1. A voice analysis method, comprising:

generating a time series of a relative pitch Prel, wherein the relative pitch Prel is a difference between a pitch Ptrack generated from music track data, which continuously fluctuates on a time axis, and a pitch Pref of a reference voice, wherein the music track data designate respective notes of a music track in time series, wherein the reference voice is a voice of a singing of the music track, and wherein, when the reference voice includes a voiceless section and when no pitch is detected from the voiceless section, the pitch Pref of the reference voice is set by an interpolation processing for the voiceless section; and generating singing characteristics data that define a model for expressing the generated time series of the relative pitch Prel.

2. The voice analysis method according to claim 1, wherein the generating a time series of a relative pitch Prel comprises:

generating the pitch Ptrack that continuously fluctuates on the time axis from the music track data;

detecting the pitch Pref of the reference voice;

setting, by the interpolation processing, the pitch Pref for the voiceless section from which no pitch is detected; and calculating a difference between the generated pitch Ptrack and the pitch Pref that is processed in the interpolation processing as the relative pitch Prel, wherein the interpolation processing sets, in accordance with the time series of the pitch Pref within a first section immediately before the voiceless section, the pitch Pref within a first interpolation section of the voiceless section immediately after the first section, and wherein the interpolation processing sets, in accordance with the time series of the pitch Pref within a second section immediately after the voiceless section, the pitch Pref within a second interpolation section of the voiceless section immediately before the second section.

3. The voice analysis method according to claim 1, wherein the generating singing characteristics data that define a model comprises:

dividing the music track into a plurality of unit sections by using a predetermined duration as a unit; and generating the singing characteristics data, wherein the singing characteristics data includes, for each of a plurality of statuses of the model, classification information and variable information, wherein the classification information is for classifying the plurality of unit sections into a plurality of sets, and wherein the variable information defines a probability distribution of the time series of the relative pitch Prel within each of the plurality of unit sections classified into each of the plurality of sets.

4. The voice analysis method according to claim 3, wherein the classification information comprises a decision tree.

5. The voice analysis method according to claim 4, wherein the generating the singing characteristics data comprises generating a decision tree for each status from a basic decision tree that is common to the plurality of statuses of the model.

6. The voice analysis method according to claim 5, wherein the generating singing characteristics data that define a model comprises:

dividing the music track into a plurality of phrases on the time axis, wherein the respective decision tree for each status includes a condition corresponding to a relationship between one of the plurality of phrases and one of the plurality of unit sections, said one phrase including said one unit section.

7. The voice analysis method according to claim 3, wherein the classification information is generated by a first classification processing based on a condition relating to an attribute of a musical note and by a second classification processing based on a condition relating to an attribute of the each of the plurality of unit sections.

8. The voice analysis method according to claim 1, wherein the model is a probabilistic model for expressing a probabilistic transition between a plurality of statuses.

9. A voice analysis device, comprising:

a processor configured when executing at least one program stored in a storage, the processor configured to:

generate a time series of a relative pitch Prel, wherein the relative pitch Prel is a difference between a pitch Ptrack generated from music track data, which continuously fluctuates on a time axis, and a pitch Pref of a reference voice, wherein the music track data designate respective notes of a music track in time series, wherein the reference voice is a voice of a singing of the music track, and wherein, when the reference voice includes a voiceless section and when no pitch is detected from the voiceless section, the pitch of the reference voice is set by an interpolation processing for the voiceless section; and generate a singing characteristics data that defines a model for expressing the generated time series of the relative pitch Prel.

10. The voice analysis device according to claim 9, the processor configured to:

generate the pitch Ptrack that continuously fluctuates on the time axis from the music track data;

detect the pitch Pref of the reference voice;

set, by the interpolation processing, the Pref pitch for the voiceless section from which no pitch is detected; and calculate a difference between the generated pitch Ptrack and the pitch Pref that is processed by the interpolation processing as the relative pitch Prel, wherein the interpolation processing sets, in accordance with the time series of the pitch Pref within a first section immediately before the voiceless section, the pitch Pref within a first interpolation section of the voiceless section immediately after the first section; and wherein the interpolation processing sets, in accordance with the time series of the pitch Pref within a second section immediately after the voiceless section, the pitch Pref within a second interpolation section of the voiceless section immediately before the second section.

11. The voice analysis device according to claim 9, the processor configured to:

divide the music track into a plurality of unit sections by using a predetermined duration as a unit; and generate the singing characteristics data, wherein the singing characteristics data includes, for each of a plurality of statuses of the model, classification information and variable information, wherein the classification information is for classifying the plurality of unit sections divided by the section setting unit into a plurality of sets, and wherein the variable information defines a probability distribution of the time series of the relative pitch Prel within each of the plurality of unit sections classified into each of the plurality of sets.

12. The voice analysis device according to claim 11, wherein the classification information comprises a decision tree.

13. The voice analysis device according to claim 12, the processor configured to generate a decision tree for each status from a basic decision tree that is common to the plurality of statuses of the model.

14. The voice analysis device according to claim 13, the processor configured to:

divide the music track into a plurality of phrases on the time axis, wherein the respective the decision tree for each status includes a condition corresponding to a relationship between one of the plurality of phrases one of the plurality of unit sections, said one phrase including said one unit section.

15. The voice analysis device according to claim 11, wherein the classification information is generated by a first classification processing based on a condition relating to an attribute of a musical note and by a second classification processing based on a condition relating to an attribute of the each of the plurality of unit sections.

16. The voice analysis device according to claim 9, wherein the model is a probabilistic model for expressing a probabilistic transition between a plurality of statuses.

17. A non-transitory computer-readable recording medium having stored thereon a voice analysis program, the voice analysis program, when executed by a computer, causing the computer to perform:

generating a time series of a relative pitch Prel, wherein the relative pitch Prel is a difference between a pitch Ptrack generated from music track data, which continuously fluctuates on a time axis, and a pitch Pref of a reference voice, wherein the music track data designate respective notes of a music track in time series, wherein the reference voice is a voice of a singing of the music track, and wherein, when the reference voice includes a voiceless section and when no pitch is detected from the voiceless section, the pitch of the reference voice is set by an interpolation processing for the voiceless section; and generating singing characteristics data that define a model for expressing the generated time series of the relative pitch Prel.

18. A voice synthesis method, comprising:

generating a relative pitch transition based on synthesis-purpose music track data and at least one singing characteristic data, wherein the synthesis-purpose music track data designate respective notes of a first music track to be subjected to voice synthesis in time series, wherein the at least one singing characteristic data define a model expressing a time series of a relative pitch Prel, wherein the relative pitch Prel is a difference between a first pitch Ptrack and a second pitch Pref, wherein the first pitch Prel is generated from music track data for designating respective notes of a second music track in time series and continuously fluctuates on a time axis, wherein the second pitch Pref is a pitch of a reference voice that is a voice of a singing of the second music track, and wherein, when the reference voice includes a voiceless section and when no pitch is detected from the voiceless section, the second pitch Pref is set by interpolation processing for the voiceless section; and generating a voice signal based on the synthesis-purpose music track data, a phonetic piece group indicating respective phonemes, and the relative pitch transition.

19. The voice synthesis method according to claim 18, further comprising editing the relative pitch transition in accordance with a user's instruction.

20. The voice synthesis method according to claim 18, wherein the at least one singing characteristics data comprises a first singing characteristics data including a first decision tree and a second singing characteristics data including a second decision tree, wherein the generating a relative pitch transition comprises:

mixing the first singing characteristics data and the second singing characteristics data, and generating the relative pitch transition corresponding to the synthesis-purpose music track data and the mixed singing characteristics data based on the model, and wherein the first decision tree and the second decision tree differ in one of size, structure, and classification.

21. A voice synthesis device, comprising:

a processor configured when executing at least one program stored in a storage, the processor configured to:

generate a relative pitch transition based on synthesis-purpose music track data and at least one singing characteristic data, wherein the synthesis-purpose music track data designate respective notes of a first music track to be subjected to voice synthesis in time series, wherein the at least one singing characteristic data define a model expressing a time series of a relative pitch Prel, wherein the relative pitch Prel is a difference between a first pitch Ptrack and a second pitch Pref, wherein the first pitch Prel is generated from music track data for designating respective notes of a second music track in time series and continuously fluctuates on a time axis, wherein the second pitch Pref is a pitch of a reference voice that is a voice of a singing of the second music track, and wherein, when the reference voice includes a voiceless section and when no pitch is detected from the voiceless section, the second pitch Pref is set by interpolation processing for the voiceless section; and generate a voice signal based on the synthesis-purpose music track data, a phonetic piece group indicating respective phonemes, and the relative pitch transition.

22. The voice synthesis device according to claim 21, the processor configured to edit the relative pitch transition in accordance with a user's instruction.

23. The voice synthesis device according to claim 21, wherein the at least one singing characteristics data comprises a first singing characteristics data including a first decision tree and a second singing characteristics data including a second decision tree, and wherein the processor is configured to:

mix the first singing characteristics data and the second singing characteristics data, and generate the relative pitch transition corresponding to the synthesis-purpose music track data and the mixed singing characteristics data based on the model, and wherein the first decision tree and the second decision tree differ in one of size, structure, and classification.

* * * * *